US007681670B2

(12) United States Patent
Centala et al.

(10) Patent No.: US 7,681,670 B2
(45) **Date of Patent: *Mar. 23, 2010**

(54) TWO-CONE DRILL BIT

(75) Inventors: Prabhakaran K. Centala, The Woodlands, TX (US); James L. Larsen, Houston, TX (US); Mohammed Boudrare, Houston, TX (US)

(73) Assignee: Smith International, Inc., Houston, TX (US)

( * ) Notice: Subject to any disclaimer, the term of this patent is extended or adjusted under 35 U.S.C. 154(b) by 474 days.

This patent is subject to a terminal disclaimer.

(21) Appl. No.: 10/938,069

(22) Filed: Sep. 10, 2004

(65) Prior Publication Data

US 2006/0054357 A1 Mar. 16, 2006

(51) Int. Cl.
*E21B 10/08* (2006.01)

(52) U.S. Cl. ..... 175/376; 175/339

(58) Field of Classification Search ..... 175/57, 175/339, 340, 393, 424, 376
See application file for complete search history.

(56) References Cited

U.S. PATENT DOCUMENTS

| | | | | |
|---|---|---|---|---|
| 930,759 | A | 8/1909 | Hughes | |
| 1,263,802 | A * | 4/1918 | Reed | 175/340 |
| 2,956,781 | A | 10/1960 | Eastman | |
| 3,112,800 | A * | 12/1963 | Bobo | 175/67 |
| 3,363,706 | A * | 1/1968 | Feenstra | 175/340 |
| 3,645,346 | A | 2/1972 | Miller et al. | |
| 4,022,285 | A * | 5/1977 | Frank | 175/65 |
| 4,077,482 | A | 3/1978 | Ioannesian et al. | |
| 4,126,194 | A | 11/1978 | Evans | |
| 4,185,706 | A * | 1/1980 | Baker et al. | 175/340 |
| 4,189,014 | A | 2/1980 | Allen et al. | |
| 4,285,409 | A | 8/1981 | Allen | |
| 4,516,642 | A * | 5/1985 | Childers et al. | 175/340 |
| 4,582,149 | A * | 4/1986 | Slaughter, Jr. | 175/340 |
| 4,687,067 | A | 8/1987 | Smith | |
| 4,759,415 | A * | 7/1988 | Pessier | 175/340 |
| 4,763,736 | A * | 8/1988 | Varel, Sr. | 175/341 |
| 4,784,231 | A | 11/1988 | Higgins | |
| 4,953,641 | A | 9/1990 | Pessier | |
| 4,989,680 | A * | 2/1991 | Deane et al. | 175/340 |
| 5,096,005 | A | 3/1992 | Ivie | |
| 5,111,894 | A | 5/1992 | Williams, Jr. | |
| 5,244,050 | A | 9/1993 | Estes | |
| 5,562,171 | A * | 10/1996 | Besson et al. | 175/339 |
| 5,775,446 | A * | 7/1998 | Lott | 175/424 |
| 6,098,728 | A | 8/2000 | Wells et al. | |
| 6,098,729 | A | 8/2000 | Matthias | |
| 6,142,247 | A * | 11/2000 | Pessier | 175/340 |

(Continued)

FOREIGN PATENT DOCUMENTS

| | | |
|---|---|---|
| EP | 0395572 | 10/1990 |

OTHER PUBLICATIONS

Combined Search and Examination Report dated Dec. 7, 2006 for Application No. GB0518247.2 (6 pages).

(Continued)

*Primary Examiner*—Jennifer H Gay
*Assistant Examiner*—David Andrews
(74) *Attorney, Agent, or Firm*—Osha • Liang LLP

(57) ABSTRACT

A two-cone drill bit with a hydraulic arrangement that can be used for one or more of the following: cleaning roller cones, impinging on a hole bottom, or inducing a helical flow field. A two-cone drill bit having a bit body formed from two leg sections and two spacing members; methods of manufacturing a two-cone drill bit; and methods of improving hydraulics of a two-cone drill bit are disclosed.

31 Claims, 14 Drawing Sheets

U.S. PATENT DOCUMENTS

| | | | | |
|---|---|---|---|---|
| 6,311,793 | B1 * | 11/2001 | Larsen et al. | 175/340 |
| 6,354,387 | B1 | 3/2002 | Harris | |
| 6,763,902 | B2 * | 7/2004 | Larsen et al. | 175/340 |
| 7,316,281 | B2 * | 1/2008 | Boudrare et al. | 175/331 |
| 2003/0196836 | A1 | 10/2003 | Larsen et al. | |

OTHER PUBLICATIONS

Smith tool co.; 'Smith Milled Tooth Bits; (4026-4027).
Canadian Office Action dated May 1, 2006 for Application No. 2,517,754 (4 pages).
Combined Search and Examination Report dated Oct. 6, 2006 issued in British Application No. GB0611329.4 (5 pages).
Combined Search and Examination Report dated Jan. 11, 2008 for Application No. GB0721097.4 (5 pages).
Combined Search and Examination Report dated Aug. 15, 2007 issued in Application No. GB0712274.0 (5 pages).
Examination Report dated Aug. 15, 2007 for Application No. GB0518247.2 (2 pages).
Examination Report issued in Application No. GB0712274.0 dated Mar. 17, 2008 (3 pages).

* cited by examiner

TWO-CONE DRILL BIT

BACKGROUND OF INVENTION

Background Art

Roller cone bits, variously referred to as rock bits or drill bits, are used in earth drilling applications. Typically, they are used in petroleum or mining operations where the cost of drilling is significantly affected by the rate that the drill bits penetrate the various types of subterranean formations. That rate is referred to as rate of penetration ("ROP"), and is typically measured in feet per hour. There is a continual effort to optimize the design of drill bits to more rapidly drill specific formations so as to reduce these drilling costs.

Roller cone bits are characterized by having roller cones rotatably mounted on legs of a bit body. Each roller cone has an arrangement of cutting elements attached to or formed integrally with the roller cone. A roller cone bit having two cones was invented in 1908 and is the predecessor of the more common three-cone bit. Two-cone bits greatly improved drilling rates in the early 1900's, but were found to suffer severe vibrations. Three-cone bits gradually replaced two-cone bits because of an increase in stability and reduction in vibrations during drilling. One advantage maintained by two-cone bits, is that they are generally able to drill faster than three-cone bits. Additionally, in smaller holes, three-cone bits result in small legs that have insufficient strength where the roller cone is rotatably mounted (the journal). Two-cone bits are able to offer larger legs relative to the hole size.

One design element that significantly affects the drilling rate of the rock bit is the hydraulics of the bit. As the rock bits drill, they generate rock fragments known as drill cuttings. Then cuttings are carried uphole to the surface by a moving column of drilling fluid that travels to the interior of the drill bit through the center of an attached drill string, is ejected from the face of the drill bit through a series of jet nozzles, and is carried uphole through an annulus formed by the outside of the drill string and the borehole wall.

Two-cone bits are typically configured with two roller cones disposed opposite of each other. Generally, between the two cones on both sides is a jet bore with an installed erosion resistant nozzle that directs the fluid from the face of the bit to the hole bottom to move the cuttings from the proximity of the bit and up the annulus to the surface. The placement and directionality of the nozzles as well as the nozzle sizing and nozzle extension significantly affect the ability of the fluid to remove cuttings from the bore hole. In some two-cone bits, a center nozzle may be included that is located on the bottom of the drill bit near the axis of the drill bit.

The optimal placement, directionality and sizing of the nozzle can change depending on the bit size and formation type that is being drilled. For instance, in soft, sticky formations, drilling rates can be reduced as the formation begins to stick to the cones of the bit. This situation is commonly referred to as "bit balling." As the inserts attempt to penetrate the formation, they are restrained by the formation stuck to the cones, reducing the amount of material removed by the insert and slowing the rate of penetration (ROP). In this instance, fluid directed toward the cones can help to clean the inserts and cones allowing them to penetrate to their maximum depth, maintaining the rate of penetration for the bit. Furthermore, as the inserts begin to wear down, the bit can drill longer because the cleaned inserts will continue to penetrate the formation even in their reduced state.

Alternatively, in a harder, less sticky type of formation, cone cleaning is not as important. In fact, directing fluid toward the cone can reduce the bit life because the harder particles can erode the cone shell causing the loss of inserts. In this type of formation, removal of the cuttings from the proximity of the bit at the hole bottom can be a more effective use of the hydraulic energy. This can be accomplished by directing nozzles with small inclinations toward the center of the drill bit such that the fluid impinges on the hole bottom, sweeps across the bottom of the drill bit and moves up the hole wall away from the proximity of the bit. This technique is commonly referred to as a cross flow configuration and has shown significant penetration rate increases in the appropriate applications.

In other applications, moving the nozzle exit point closer to the hole bottom can significantly affect drilling rates by increasing the impact pressures on the formation. The increased pressure at the impingement point of the jet stream and the hole bottom as well as the increased turbulent energy on the hole bottom can more effectively lift the cuttings so that they can be removed from the proximity of the bit. This application of nozzles also helps to avoid a situation commonly referred to as "bottom balling." During bottom balling, filter cake from the drilling fluid reduces the ability of the cutting elements on the drill bit to cut new formation, which results in a decreased ROP. To optimize the hydraulics of the two-cone bit, the designer must understand the formation being drilled and how to design the hydraulics on the bit to clean the bit and hole bottom appropriately.

Improvements in drill bit design and other drilling technology have reduced some of the issues involved in drilling with two-cone bits. Increased stability and lifespan of two-cone bits make them a potentially attractive alternative to three-cone bits. Additionally, two-cone bits provide a space saving advantage that allows for more flexibility in the design of hydraulics for the drill bit.

SUMMARY OF INVENTION

In one aspect, the present invention relates to a two-cone drill bit for drilling a well bore. The drill bit includes a bit body having a connection adapted to connect to a drill string. The bit body includes two legs disposed between about 145 degrees and about 180 degrees from each other. A fluid plenum is formed inside of the bit body. The bit body has at least two openings on a first side of the bit body between the two legs. A roller cone is rotatably mounted to each leg.

In another aspect, the present invention relates to a two-cone drill bit for drilling a well bore. The drill bit includes a bit body having a connection adapted to connect to a drill string. The bit body includes not more than two leg sections. Each leg section has a leg formed thereon that extends from the bit body for the attachment of a cone such that the legs are disposed between about 145 degrees and about 180 degrees from each other. A fluid plenum is formed inside of the bit body. Two spacing members disposed on the bit body on opposite sides from each other between each of the not more than two leg sections. A roller cone is rotatably mounted to each leg.

In another aspect, the present invention relates to a method of manufacturing a two-cone drill bit. The method includes forming a bit body have two legs disposed between about 145 degrees and about 180 degrees from each other. At least two openings are formed in the bit body such that the at least two openings form a conduit for channeling fluid from the fluid plenum to outside the bit body. The at least two openings are disposed on a first side of the bit body between the two legs.

In another aspect, the present invention relates to a method of manufacturing a two-cone drill bit. The method includes forming two leg sections. A leg is formed on each leg section. Two spacing members are formed. A bit body is then formed by attaching the two leg sections and two spacing members such that the leg sections are disposed between about 145 degrees and about 180 degrees from each other and the two spacing members are disposed on opposite sides from each other between each of the two leg sections.

In another aspect, the present invention relates to a method of improving the hydraulics of a two-cone drill bit. The method includes orienting each of at least four nozzles to perform a function. The function is selected from cleaning a first roller cone, cleaning a second roller cone, impinging on a hole bottom, and inducing a helical flow field.

Other aspects and advantages of the invention will be apparent from the following description and the appended claims.

DETAILED DESCRIPTION

In one or more embodiments, the present invention relates to hydraulic arrangements for a two-cone drill bit. In one or more embodiments, the present invention relates to a two-cone drill bit having a body formed from two leg sections and two spacing members.

A more detailed description of three functions provided by rotary cone rock bits hydraulics is provided to illustrate reasons for optimizing the hydraulic configuration for specific drilling applications.

Figure 16:
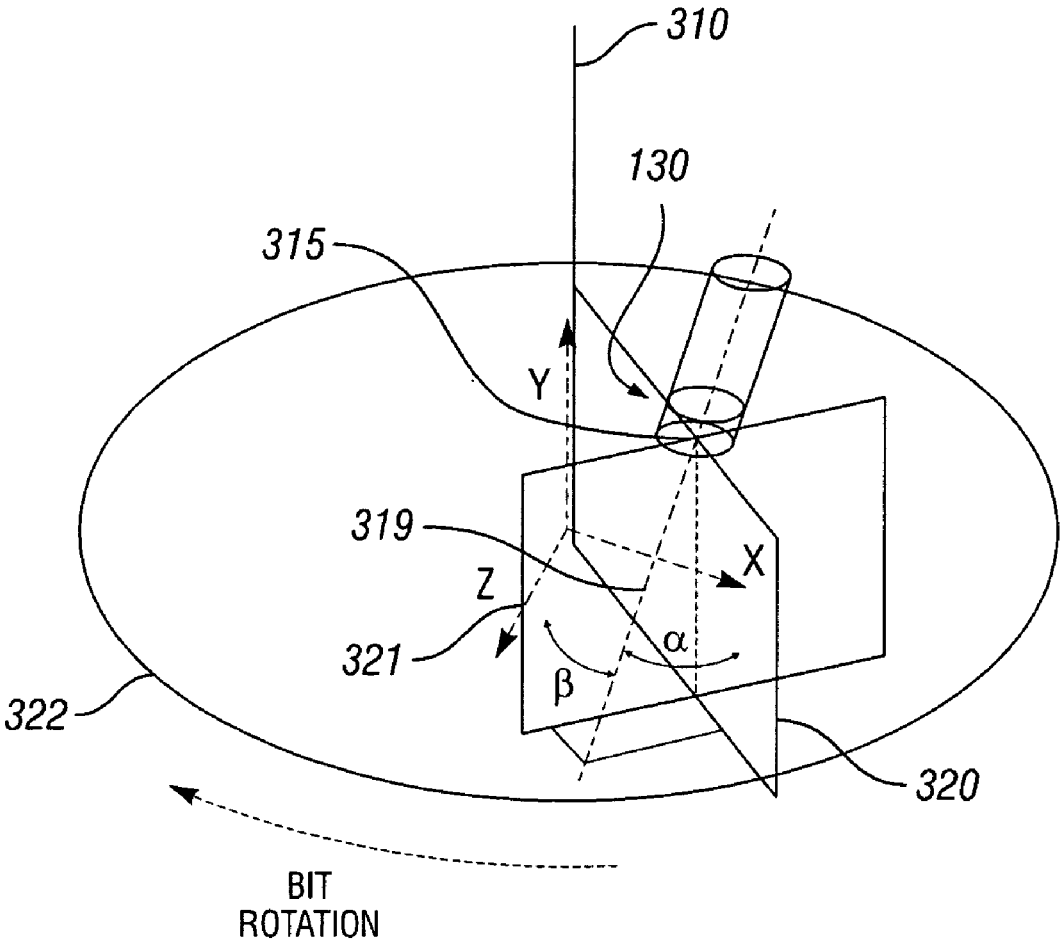
FIG. 16 shows the orientation definitions for a nozzle in space.

To understand the orientation of the nozzle, it is useful to define an orientation system to describe how a nozzle may be oriented within the bit body. FIG. 16 shows a nozzle receptacle 130. The position of the receptacle 130 is defined by 3 translational dimensions X, Y, and Z, and the orientation is defined by two vector angles, lateral angle $\alpha$ and radial angle $\beta$. The coordinate system for the X, Y, and Z dimensions is located along the bit centerline axis 310 and is fixed relative to the bit body (not shown). A nozzle receptacle center point 315 is located at the desired position by setting the values of X, Y and Z. The receptacle center point 315 is located on the external bit body surface, usually identified by a spot face, where the nozzle receptacle exits the bit or on the spot face of an attachable tube. The orientation of the nozzle receptacle is set by adjusting the values of lateral angle $\alpha$ and radial angle $\beta$. As used herein, the lateral angle $\alpha$ is the angle between the nozzle receptacle centerline 319 and the reference plane 320 that passes through the bit centerline axis 310 and the nozzle receptacle center point 315. As used herein, the radial angle $\beta$ is the angle between the nozzle receptacle centerline 319 and the reference plane 321, which is perpendicular to reference plane 320 and passes through the nozzle receptacle center point 315. Increasing and decreasing lateral angle $\alpha$ affects the circumferential movement of the fluid around the bore hole 322. Increasing and decreasing the size of the radial angle $\beta$ directs the fluid away from or toward the bit centerline axis 310. As used herein, values for a lateral angle and a radial angle are absolute values of the respective angle (i.e. without regard to positive or negative). The direction of the fluid could also be changed by the installation of a nozzle in the nozzle receptacle 130 that directed the fluid vector in a direction other than that defined by the nozzle receptacle centerline 319. It would be appreciated by one skilled in the art that using a nozzle to adjust the direction of the fluid would be equivalent to machine the nozzle bore such that it accomplished the same hydraulic purpose.

Cutting Structure Cleaning

At the very soft end of the formation spectrum (e.g., clay and sand-based formations), there is a strong tendency for formation cuttings to adhere to the teeth or inserts of bits. As mentioned above, the adhesion of formation to teeth or inserts is commonly referred to as "bit balling." As is known in the art, bit balling describes the packing of formation between the cones and bit body, or between the bit cutting elements, while cutting formation. When bit balling occurs, the cutting elements are "packed off" so that they are unable to penetrate into the formation effectively, tending to slow the rate of penetration for the drill bit (ROP). For example, "gumbo," which is a term used in the art to describe a particular earth formation in the US Gulf Coast region, is an example of a formation where bit balling is common. Accordingly, steps to remove the formation must be taken to maintain reasonable penetration rates. Cone cleaning reduces the problem of bit balling, and thus, effective cone cleaning is a desirable feature of bit design in earth formations that cause bit balling.

Bottom Hole Cleaning

In addition to preventing bit balling, hydraulic systems in rock bits should provide "bottom hole cleaning." When the rock being drilled is fractured, the resulting cuttings must be removed before the next insert/tooth is presented to that area on the hole-bottom. Failure to remove cuttings from the hole bottom results in those cuttings being re-drilled, inefficiently using mechanical energy that would otherwise be used on drilling new formation.

In addition, teeth and inserts penetrating through a layer of fractured cuttings are more likely to have contact between cuttings and the cone-shell of the bit. This could lead to abrasion of the supporting steel resulting in insert loss or tooth breakage.

To improve bottom hole cleaning, nozzles may be arranged such that the drilling fluid contacts the bore hole bottom with maximum or near-maximum "impingement pressure." "Impingement pressure" as used herein refers to the force directed into the earth formation by the fluid exiting from the nozzle divided by the area of the fluid from the nozzle. Five factors that affect impingement pressure include: 1) proximity of the nozzle to the hole bottom; 2) the inclination angle of the fluid relative to the hole bottom; 3) internal nozzle geometry; 4) the global characteristics of the flow domain; and 5) bit body interference. Each of these factors are discussed in more detail below.

1) Proximity of the Nozzle to the Hole Bottom

As the fluid begins to exit the nozzle bore, the fluid has a velocity profile consistent with the total flow area of the bit. For example, if a cross-sectional area of the nozzle bore is reduced, the velocity of the fluid is increased. The total flow area of the drill bit is determined by summing up all the minimum flow areas of each nozzle disposed on the bit. Once the fluid exits the nozzle bore and interacts with the surrounding fluid in the drilled bore, the velocity of fluid begins to decrease. Accordingly, it follows that the further the nozzle exit is offset from the hole bottom, the more the velocity of the fluid is reduced (because the fluid exiting the nozzle has longer to interact with surrounding fluid). Because the impingement pressure is proportional to the velocity of the fluid as it approaches the bottom of the bore hole, changes in the nozzle distance from the hole bottom will affect the impingement pressure.

Figure 1:
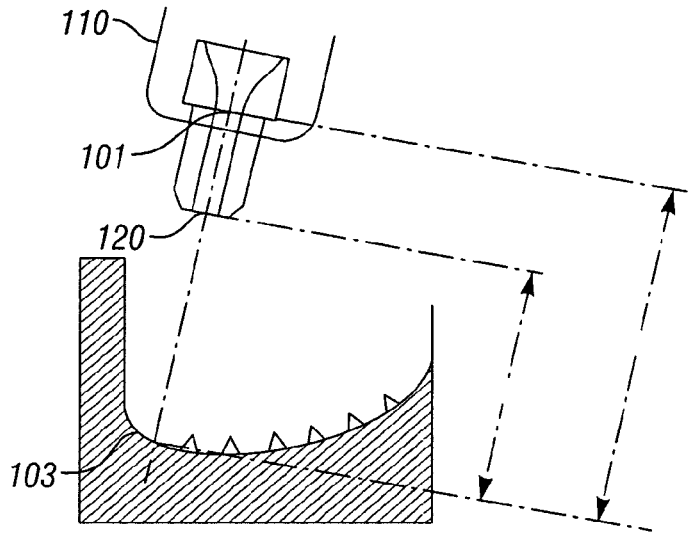
FIG. 1 shows a side view of a nozzle configuration for impinging on a hole bottom.

If the nozzle exit is located closer to the hole bottom, less surrounding fluid is entrained into the fluid exiting from the nozzle, allowing the fluid exiting the nozzle to impact the hole bottom with a higher impingement pressure. FIG. 1 shows a nozzle configuration used for tests on impingement pressure and its relation to distance from the hole bottom. In the nozzle configuration of FIG. 1, a mini-extended nozzle 120 is used in series with an embedded nozzle 101 that is attached to the drill bit 110. To determine the effects of nozzle distance on impingement pressure, a series of tests were run using a 7⅞" drill bit 110 with a non-extended or embedded nozzle 101 only. Tests were also run with the mini-extended nozzle 120 in series with the embedded nozzle 101, as shown in FIG. 1. In this case, the non-extended nozzle 101 was 4.76" from the hole bottom 103 and the mini-extended nozzle 120 was 3.28" from the hole bottom 103, as measured along the trajectory for fluid exiting the nozzles. The position and angles of the nozzles were the same for both runs. In this example, the mini-extended nozzle 120 is a separate piece and used in series with an embedded nozzle 101. However, one of ordinary skill in the art will appreciate that the mini-extended nozzle 120 and embedded nozzle 101 may be combined into a single piece without departing from the scope of the invention.

Figure 2:
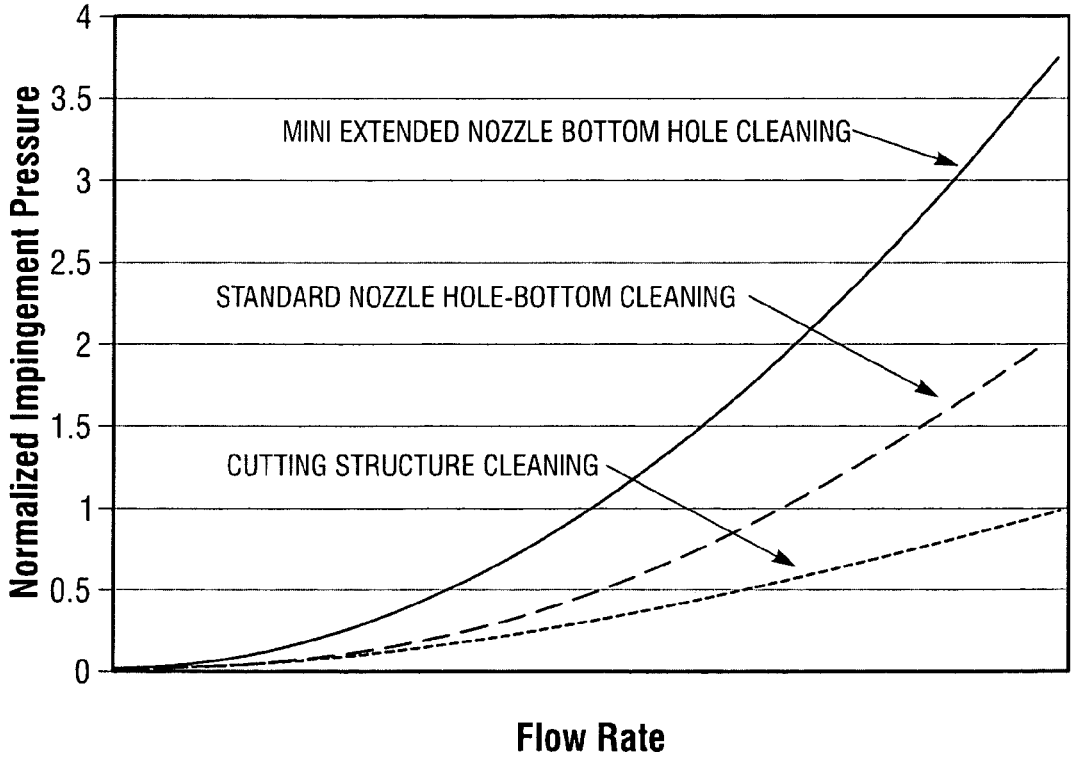
FIG. 2 shows a chart of flow rate versus impingement pressure for the nozzle configuration in FIG. 1.

FIG. 2 shows a plot of maximum impingement pressure as a function of flow rate for the nozzle configurations shown in FIG. 1. In FIG. 2, the mini-extended nozzle 120 exhibited an approximately 100 percent increase in impingement pressure as compared to the standard nozzle 101 run. Similar distance to impingement pressure relationships would be expected for other sizes of drill bits and nozzles.

The lateral and radial angles of the nozzle also affects the distance to the hole bottom, and thus, affects the impingement pressure. If the radial and lateral angles are 0 degrees, the nozzle axis would be substantially parallel to the axis of the drill bit. A higher lateral angle is typically used to aim the fluid towards a roller cone. As the lateral angle of the nozzle is increased to improve cone cleaning, the distance to the hole bottom is also typically increased. The increased distance to the hole bottom is one factor that contributes to the reduced impingement pressure on the hole bottom, such as when the nozzle is cleaning the cutting structure.

2) Inclination Angle

The impingement pressure is also affected by the "inclination angle" of fluid relative to the hole bottom. "Inclination angle" as used herein refers to the angle at which the fluid exiting a nozzle hits the hole bottom. If the fluid hits the hole bottom at a 90° angle (i.e. perpendicular to the hole bottom), it fully "stagnates," which maximizes the impingement pressure. However, as the jet stream angle decreases to less than 90°, the impingement pressure goes down because less of the fluid is directed into the hole bottom. Thus, when maximum impingement pressure on the hole bottom is desired, such as for bottom hole cleaning, an inclination angle close to 90° is desired.

3) Nozzle Geometry

The conditioning of fluid in the nozzle can significantly affect impingement pressure. For example, if a diffuser nozzle (which serves to widen the stream of fluid exiting the nozzle) is used in the jet bore, the fluid will slow down within the nozzle, thus lowering the impingement pressure. On the other hand, if a mini-extended nozzle is used, turbulent eddy currents within the fluid will be dampened, minimizing diffusion entrainment as the fluid exits the nozzle. "Diffusion entrainment" as used herein refers to the mixing of high velocity fluid exiting the nozzle with fluid outside the nozzle. This mixing results from the low pressure at the exit of the nozzle, which draws fluid from outside the nozzle towards the exit of the nozzle. The mixing results in a deceleration of the fluid exiting the nozzle. Minimizing the diffusion entrainment maintains a higher fluid velocity after exiting the nozzle. When this is achieved, the fluid impacts the hole bottom at a higher velocity, and thus, raises bottom hole impingement pressures.

4) Global Characteristics of the Flow Domain

Figure 3:
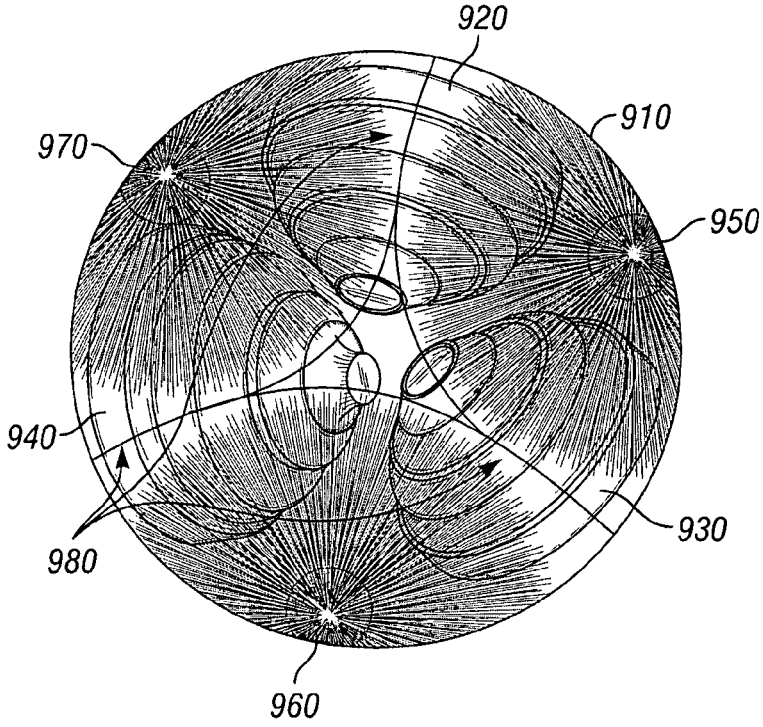
FIG. 3 shows a bottom view of a flow analysis of a three-cone drill bit.

Nozzle orientation can significantly affect the impingement pressure on the hole bottom. FIG. 3 illustrates the bottom hole velocity profile of a bit with three nozzles oriented for bottom hole cleaning (i.e. with a low lateral angle). Circular periphery 910 surrounds three cutting cones 920, 930, 940 and the locations for three nozzles 950, 960, 970. Each nozzle passes midway between two adjacent cones and has a very low lateral angle. As is illustrated by FIG. 3, as the fluid from each nozzle impinges on the hole bottom, it moves uniformly from the hole wall and the impingement point in a semi-hemispherical direction. The fluid from each nozzle interacts with fluid from the other nozzles underneath the cones to form interaction zones 980. Because each interaction zone is displaced a rather large distance from any impingement zone, the three nozzles have very little effect on each others' impingement pressures.

Figure 4:
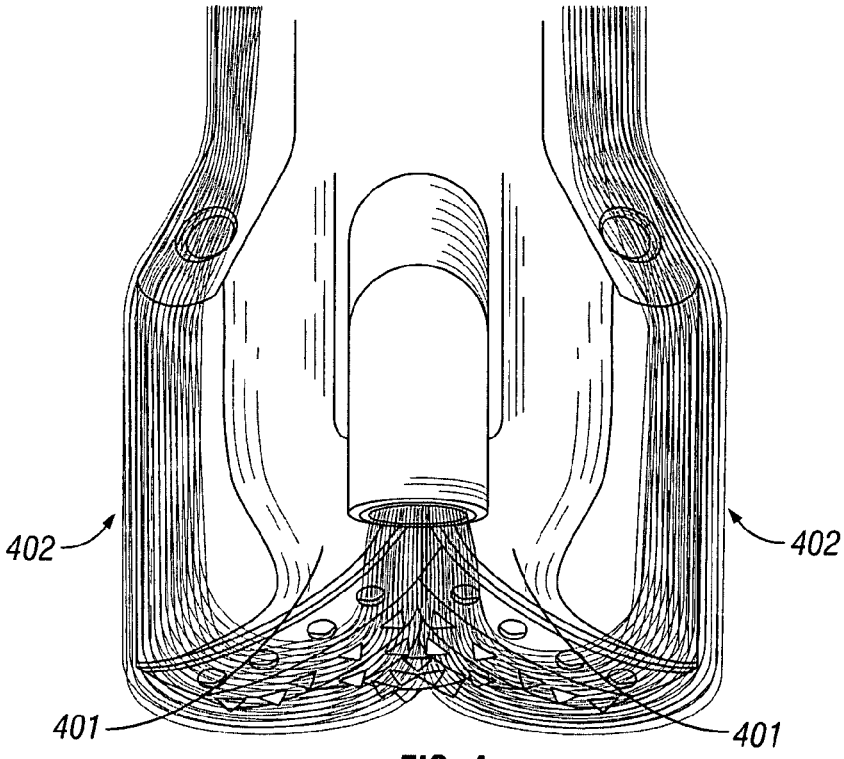
FIG. 4 shows a side view of a flow analysis of the three-cone drill bit in claim 3.

Turning to FIG. 4, when the fluid from the two nozzles meet at the interaction zone, the fluid turns either inboard (i.e., towards the center of the hole) or outboard (i.e., towards the hole wall). Referring to FIG. 4, when a nozzle has a very low lateral angle, much of the fluid 402 exiting the nozzle moves up the back of the legs 401 as the fluid 402 moves away from the drill bit.

Figure 5:
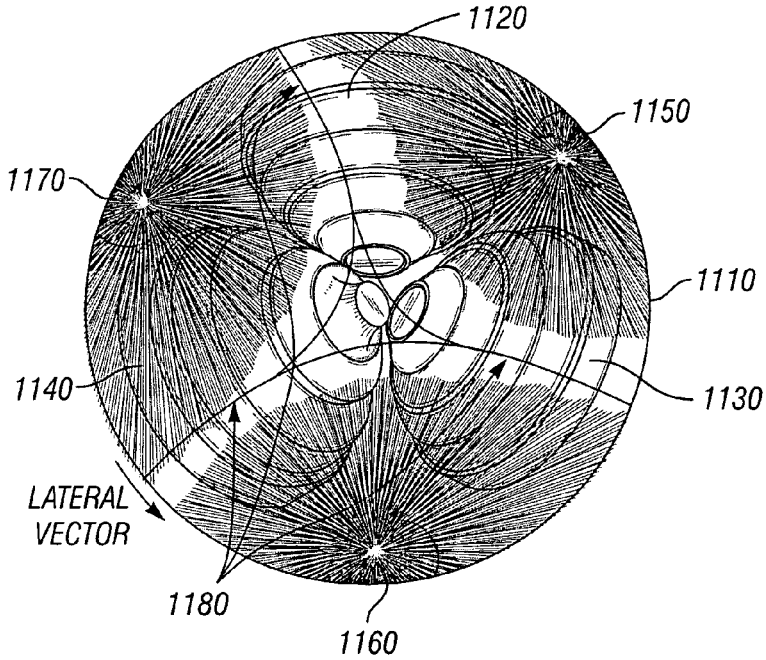
FIG. 5 shows a bottom view of a flow analysis of a three-cone drill bit.

In contrast, FIG. 5 illustrates the bottom hole velocity profile of a bit with nozzles oriented for cone cleaning (i.e. a high lateral angle). In FIG. 5, a cylindrical periphery 1110 surrounding three cutting cones 1120, 1130, 1140 is shown. Three locations 1150, 1160, 1170 can also be seen, as well as interaction zones 1180 between the nozzles. Each nozzle has a significant lateral angle which causes the interaction zones 1180 to become elongated. Because of the close proximity of the interaction, the nozzles affect each others' impingement pressure by adding a large lateral velocity vector to the fluid streams, effectively increasing the angle at which each fluid stream impinges on the hole bottom. While the nozzles oriented for cone cleaning in this example have a high lateral angle, one of ordinary skill in the art will appreciate that cone cleaning may be achieved with a reduced lateral angle if the nozzle is located in a position closer to the cone such that fluid exiting the nozzle is directed near the cone.

5) Bit Body Interference

Figure 6:
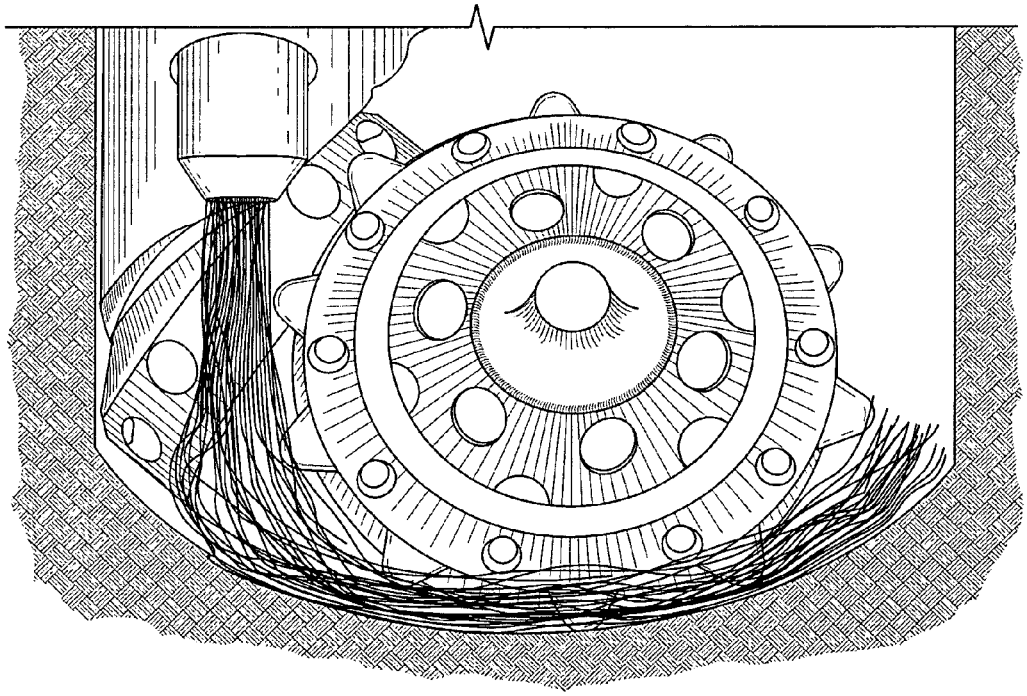
FIG. 6 shows a side view of a flow analysis of a three-cone drill bit.

When the nozzle is oriented to clean the cone, the fluid stream passes in close proximity to the cone inserts or teeth, as shown in FIG. 6. As the insert passes in and out of the fluid stream, the impingement pressure on the hole bottom fluctuates back and forth resulting in an overall lower average impingement pressure than if the rotating cone were absent. The fluid stream also diffuses as it passes around the inserts. The diffusion further decelerates the fluid stream.

Cuttings Evacuation

When cuttings are produced, not only must they be removed from the hole bottom and prevented from sticking to one of the cones, but they also must be transported away from the bit/formation interface and into the annulus for transportation to the surface. In very soft and/or sticky formations, failure to evacuate the cuttings efficiently can lead to re-grinding or possibly balling of the cuttings with a consequent reduction in ROP. At the other end of the spectrum, in hard and abrasive formations, failure to evacuate the cuttings can cause excessive cone shell erosion and damage to the drill bit. The most effective method for achieving proper cutting evacuation will vary based on the earth formation being drilled among other parameters, such as depth, drilling fluid, and drill bit design.

Figure 7A:
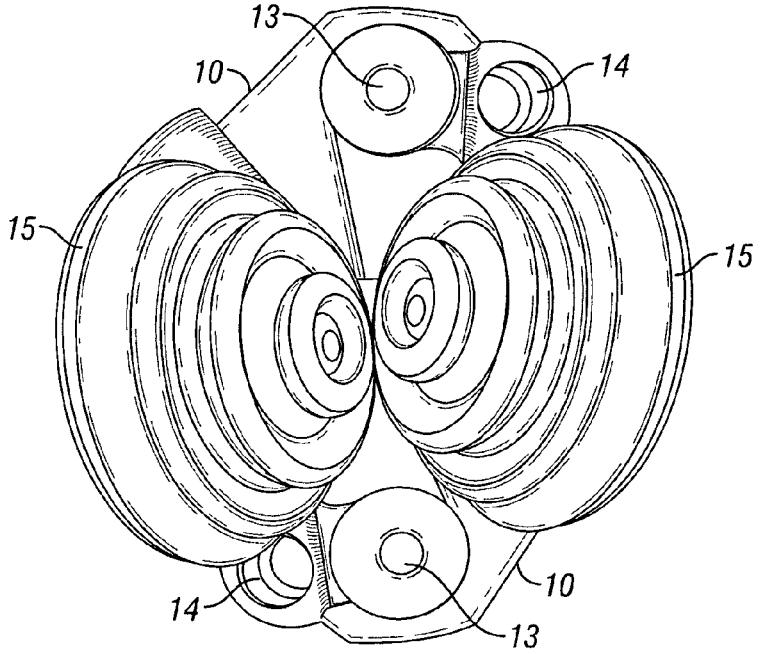
FIG. 7A shows a bottom view of a two-cone drill bit in accordance with an embodiment of the present invention.
Figure 7B:
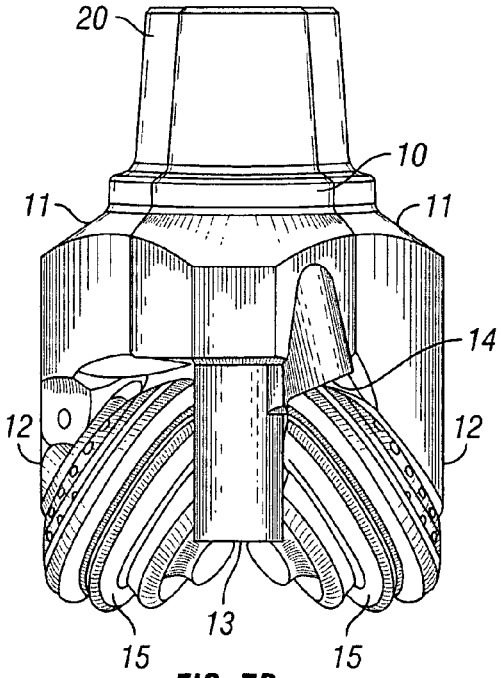
FIG. 7B shows a side view of the two-cone drill bit shown in FIG. 7A.
Figure 7C:
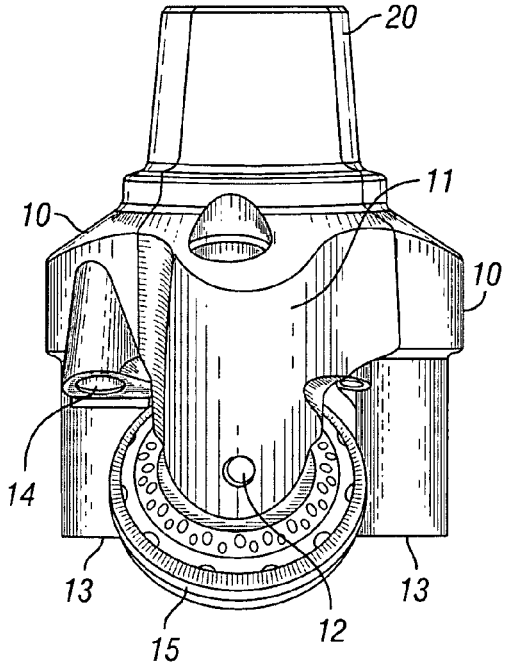
FIG. 7C shows a side view of the two-cone drill bit shown in FIG. 7A.

FIGS. 7A, 7B, and 7C show views of a two-cone drill bit in accordance with one embodiment of the present invention. In this embodiment, the bit body is formed using four primary pieces. In this particular embodiment, two leg sections 11 are located between about 163 degrees and 165 degrees from each other. In another embodiment, the leg sections 11 may be between about 145 degrees to about 180 degrees from each other. In some embodiments, the leg sections 11 may be about 155 degrees to about 165 degrees from each other. A discussion on how arranging the leg sections 11 affects the stability of a two-cone drill bit is provided in the co-pending application, "Two-Cone Drill Bit with Enhanced Stability," by Mohammed Boudrare et al. filed on the same day as the present invention. That application is incorporated by reference in its entirety. Between the two leg sections 11, and on each side, is a spacing member 10. For improved strength, the leg sections 11 may be forged steel. For improved internal geometry, the spacing members 10 may be formed using cast steel. Alternatively, spacing members 10 may be forged and machined for improved strength if necessary. The leg sections 11 and spacing members 10 are formed separately and combined to form the bit body. Typically, this would be accomplished by welding the pieces together.

Each leg section 11 includes a leg 12, which has a roller cone 15 rotatably mounted thereon. Cutting elements (not shown) would be arranged on each of the roller cones 15. After combining the spacing members 10 and leg sections 11, a connection 20 is formed to allow for connection the drill bit to a drill string.

In this embodiment, each spacing member 10 is formed with two openings 13 and 14. Each opening 13 and 14 may be adapted to hold a nozzle, not shown. Opening 14 is directed such that fluid flow passes in close proximity to the roller cone 15, such that cuttings may be removed from the roller cone 15. In this embodiment, opening 13 is at a location near the bottom of the drill bit. Fluid passing through opening 13 is directed towards the hole bottom (not shown), such that material is removed from the hole bottom to avoid bottom-balling. In other embodiments, opening 13 may be directed at an angle relative to the hole bottom, instead of directly at the hole bottom as in the embodiment shown in FIGS. 7A, 7B, and 7C. Opening 13 could also be moved further away from or closer to the hole bottom to increase or decrease the bottom hole energy.

Figure 8C:
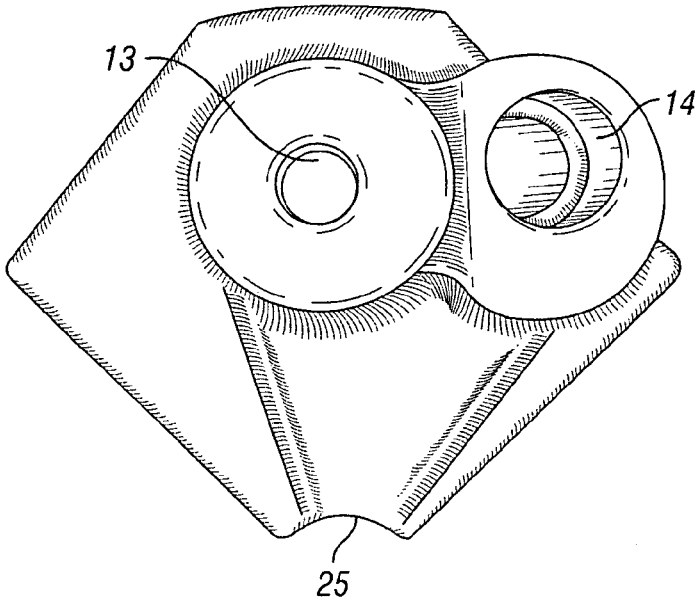
FIG. 8C shows an end view of the spacing member shown in FIG. 8A.
Figure 8A:
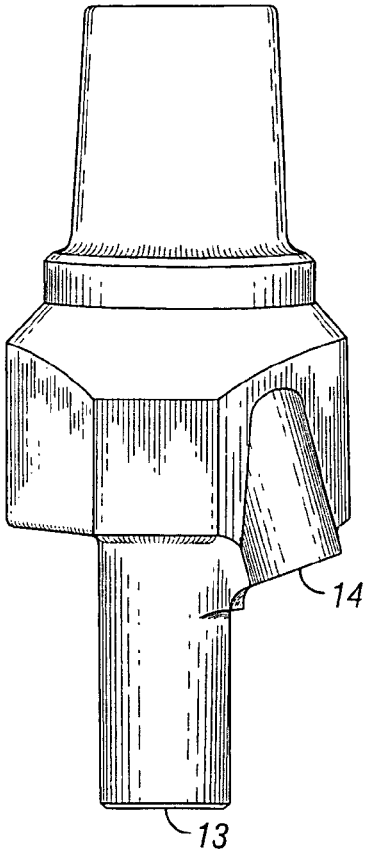
FIG. 8A shows a side view of the outer portion of a spacing member in accordance with one embodiment of the present invention.
Figure 8B:
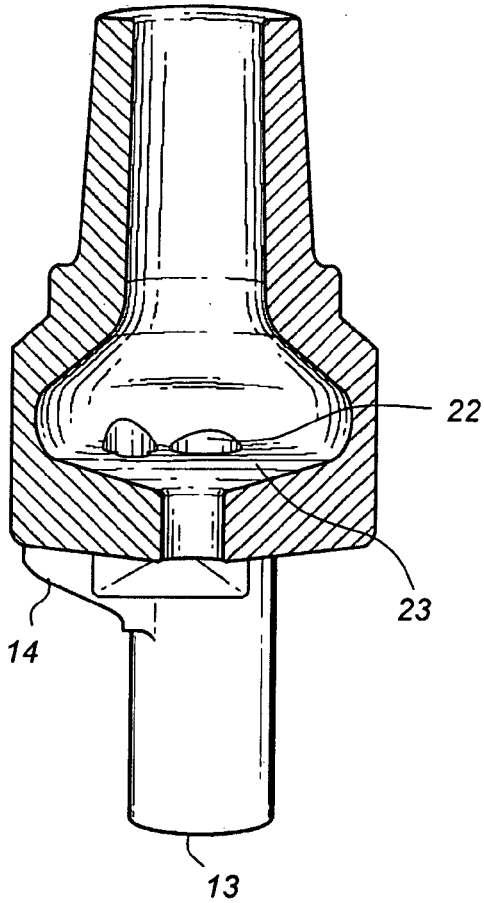
FIG. 8B shows a side portion of an inner portion of the spacing member shown in FIG. 8A.

Turning to FIGS. 8A, 8B, and 8C, the spacing member 10 from the embodiment in FIG. 7A is shown. FIG. 8B shows an internal view of the spacing member 10. In this embodiment, a portion of a fluid plenum 23 is formed on the inside of the spacing member 10. When combined, the internal geometry of each spacing member 10 and the leg sections 11 form a fluid plenum 23. Also shown, is an entrance to a conduit 22 that directs fluid from the fluid plenum 23 to the openings 13 and 14. The conduit 22 is in fluid communication between the fluid plenum 23 and the annular space surrounding the drill bit. The conduit 22 may be designed to provide a smooth transition from the relative low velocity fluid flow in the fluid plenum 23 to the accelerated fluid flow that occurs as the fluid exits through openings 13 and 14.

FIG. 8C shows a portion of a center opening 25. A similar arc may be formed in the leg sections 11, such that, when combined, the bit body has a center opening 25 that may be adapted to hold a center nozzle directed downward from the center of the drill bit. Alternatively, the center opening 25 may be formed using any appropriate machining practice after forming the bit body. The center opening 25 directs fluid from the fluid plenum to a location between the two roller cones (not shown). This helps to clean the portion of each roller cone near the center of the drill bit.

Figure 9A:
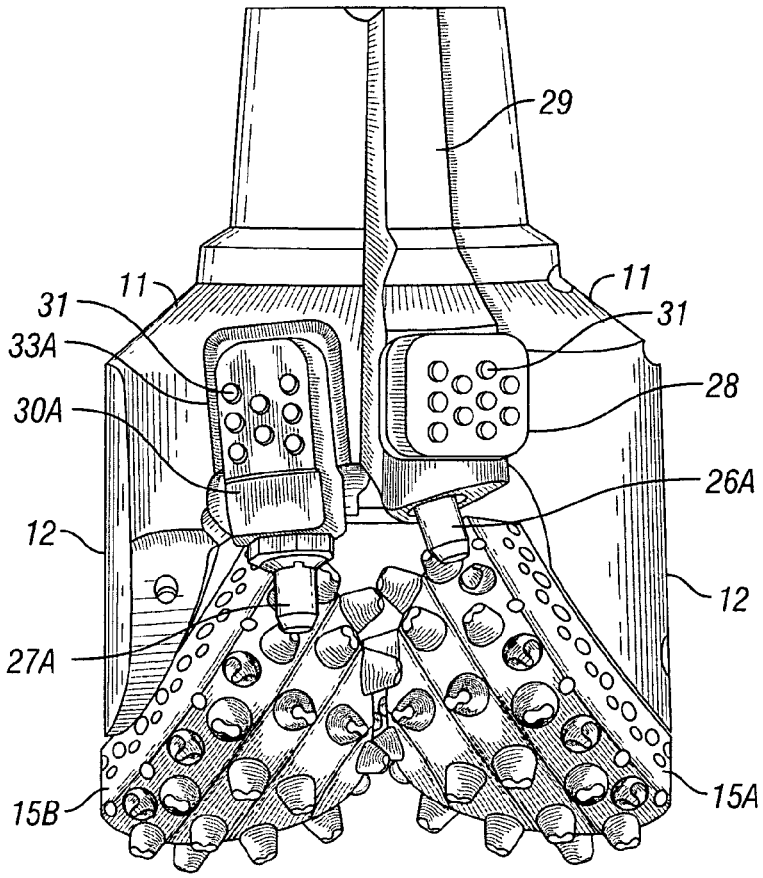
FIG. 9A shows a side view of a two-cone drill bit in accordance with an embodiment of the present invention.
Figure 9B:
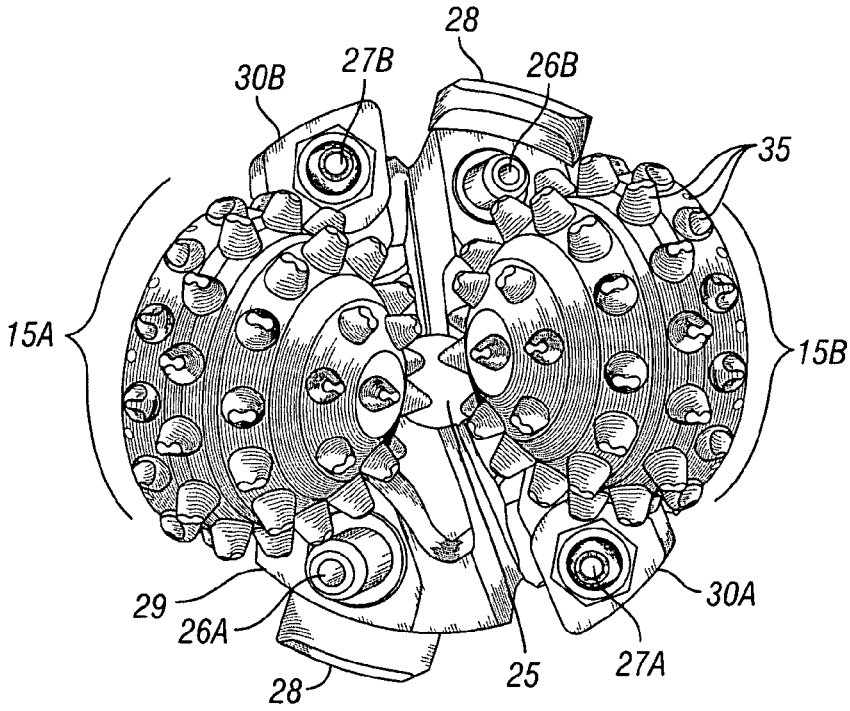
FIG. 9B shows a bottom view of the two-cone drill bit shown in FIG. 9A.

Turning to FIGS. 9A and 9B, another two-cone drill bit in accordance with an embodiment of the present invention is shown. In this embodiment, each spacing member 29 has an opening with an attached cone cleaning nozzle 26, which is also known as a directed nozzle. The cone cleaning nozzles 26A, 26B may be aimed such that fluid flow passes near the cutting elements 35 to remove cuttings from the roller cones 15A, 15B, respectively. The cone cleaning nozzles 26A, and 26B are positioned by adjusting X, Y, and Z translations of the nozzles. For drill bits that are 7⅞" or larger, it is desirable that the centerline projection of the cone cleaning nozzle passes within 0.4" or less of the cone or a row of cutters so that sufficient energy is expended on the cutters to wash away detritus from the cutter surfaces. It is even more desirable to have a nozzle centerline projection that passes by the cone or a row of cutters that passes within 0.30" or less. The spacing member 29 may also include a gauge pad 28 having a diameter that matches the diameter of hole drilled by the drill bit. The gauge pad 28 may also include inserts 31 made of a wear resistant material, such as tungsten carbide or polycrystalline diamond (PCD), to prevent wear of the outer portion of the drill bit. Also shown in FIGS. 9A and 9B, is a center opening 2S at the intersection of the leg sections 11 and spacing members 29.

In this embodiment, a pocket 33 is formed in each leg section 11. Hydraulic attachments 30A, 30B are adapted to fit in and attach to the pockets 33. The hydraulic attachments 30A, 30B may include hole bottom cleaning nozzles 27A, 27B. The hole bottom cleaning nozzles 27A, 27B are aimed such that fluid flow impinges on the hole bottom and creates a high impingement pressure zone that helps to clean cuttings from the bottom of the hole. Hole bottom cleaning nozzles typically have lateral angles less than a magnitude of about 5 degrees. Generally, the highest impingement pressure is achieved with a lateral angle of about 0 degrees. The present inventors have found that radial angles have less of an influence on the impingement pressure because of the shape of the bottom hole, and that radial angles do not bias the fluid to begin circulating around the circumference of the hole. In one embodiment, a radial angle of about 0 degrees is used for the hole bottom cleaning nozzles 27A, 27B The hydraulic attachment 30 may also have inserts 31 to reduce wear of the outer portion of the drill bit. Similar hydraulic attachments are disclosed in U.S. application Ser. No. 09/814,916, which is assigned to the assignee of the present invention. That application is incorporated by reference in its entirety.

Figure 10A:
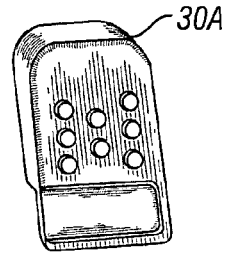
FIG. 10A shows a hydraulic attachment piece in accordance with one embodiment of the present invention.
Figure 10B:
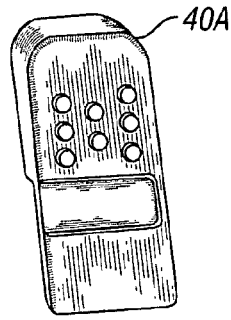
FIG. 10B shows a hydraulic attachment piece in accordance with one embodiment of the present invention.

FIGS. 10A and 10B show alternative hydraulic attachments that may be adapted to fit in a pocket formed in a leg section. FIG. 10A shows the hydraulic attachment 30A shown on the drill bit in FIG. 9A. FIG. 10B shows a hydraulic attachment 40A that may be attached to the pocket formed in the leg section. Hydraulic attachment 40A has an extended lower portion that protrudes from the bottom of the drill bit when attached. This causes the opening (not shown) at the bottom to be in closer proximity to the hole bottom during drilling. As a result, fluid exiting from the hydraulic attachment 40A may impact the hole bottom with a greater impingement pressure.

Figure 11A:
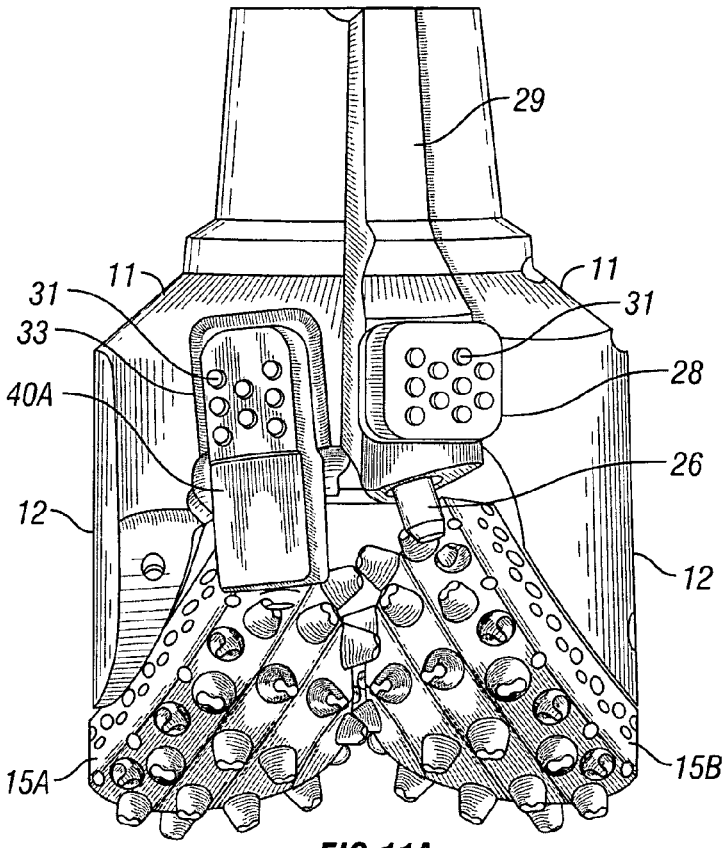
FIG. 11A shows a side view of a two-cone drill bit in accordance with an embodiment of the present invention.
Figure 11B:
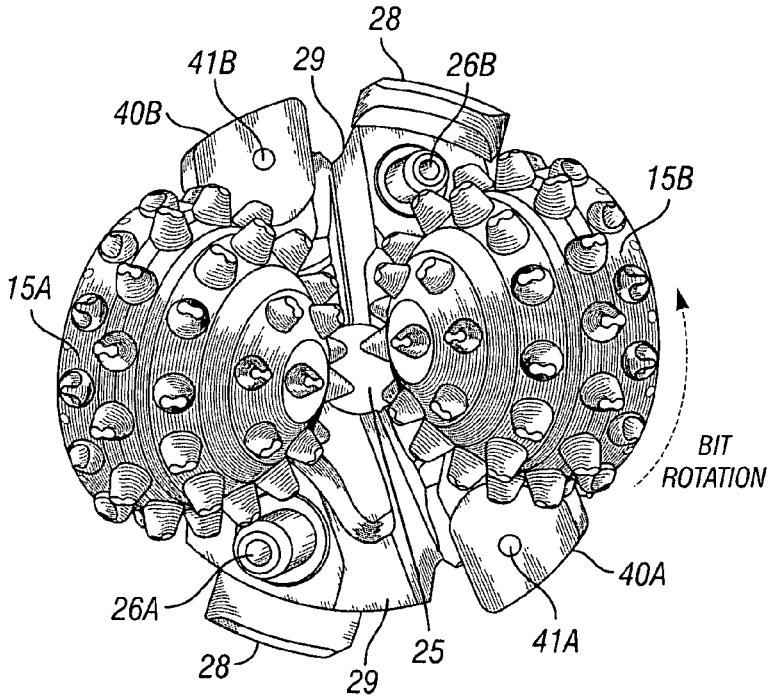
FIG. 11B shows a bottom view of the two-cone drill bit shown in FIG. 11A.

In FIGS. 11A and 11B, a two-cone drill bit in accordance with an embodiment of the invention is shown. In this embodiment, hydraulic attachment 40A, 40B are attached to the pockets 33. The lower portion of the hydraulic attachments 40A, 40B protrude from the bottom of the drill bit as discussed above in FIG. 10B. The hydraulic attachments 40A, 40B may also include inserts 31 to reduce wear of the outer portion of the drill bit. In this embodiment, openings 41A, 41B are shown in the bottom of the hydraulic attachments 40A, 40B, respectively. Alternatively, nozzles (not shown) may be attached to the hydraulic attachments 40A, 40B. In this embodiment, the lower portions of the hydraulic attachments 40A, 40B only protrudes partially from the bottom of the drill bit. In other embodiments, the lower portion may extend further to be closer to the hole bottom. One of ordinary skill in the art will appreciate that the length of the lower portion of the hydraulic attachment may vary without departing from the scope of the present invention.

Figure 12A:
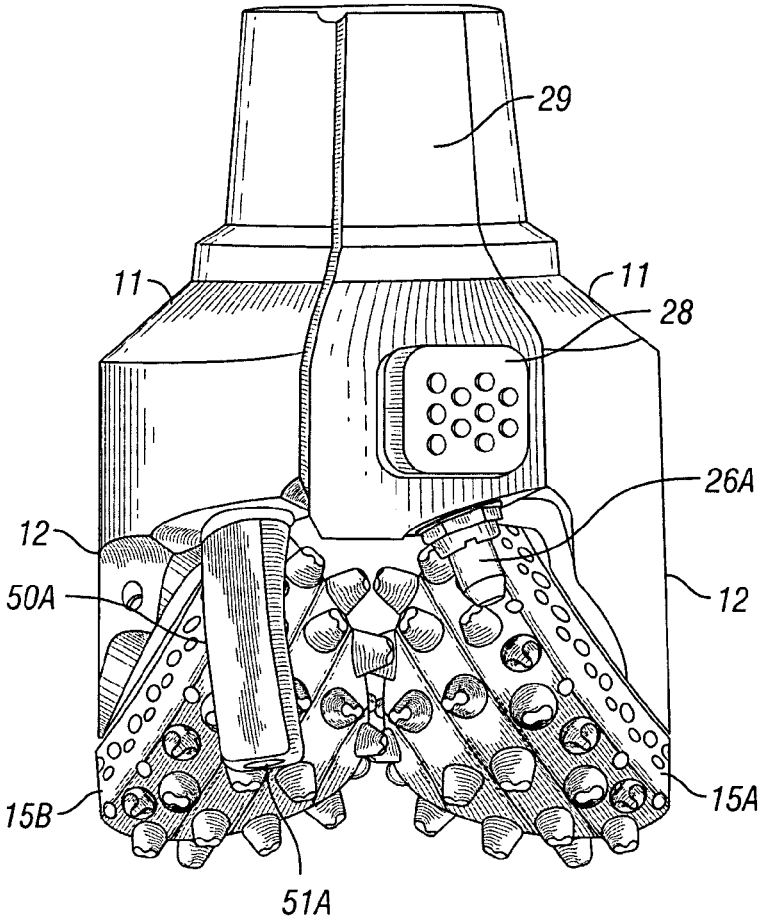
FIG. 12A shows a side view of a two-cone drill bit in accordance with an embodiment of the present invention.
Figure 12B:
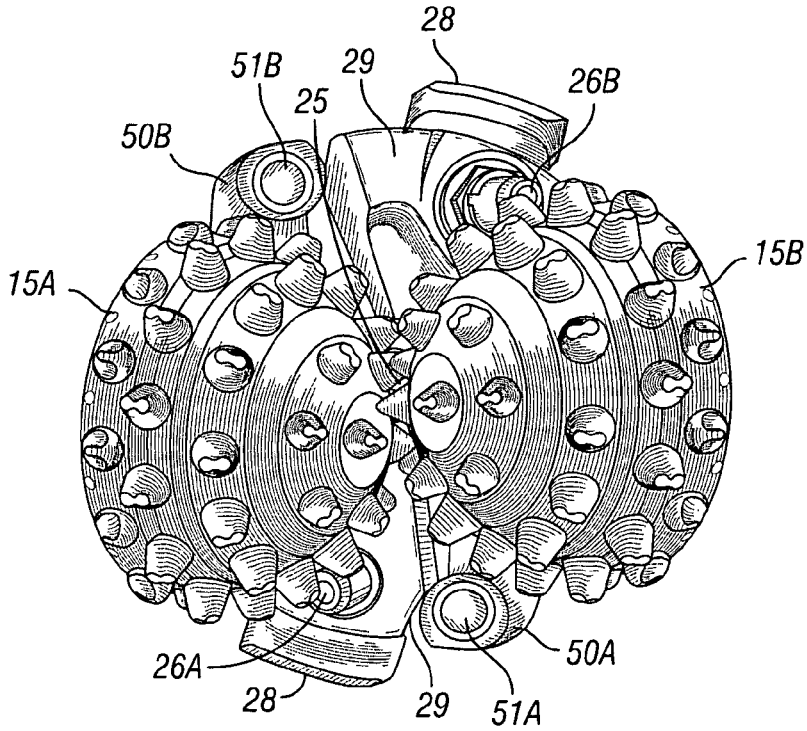
FIG. 12B shows a bottom view of the two-cone drill bit shown in FIG. 12A.

Turning to FIGS. 12A and 12B, a two-cone drill bit in accordance with an embodiment of the present invention is shown. In this embodiment, a hole is formed in the bottom of the leg section 11. Extension pieces 50A, 50B may be adapted to attach to the holes in the leg section 11. The extension pieces 50A, 50B each have a conduit formed therein for channeling fluid from a fluid plenum (not shown) to openings 51A, 51B at the lower extent of the extension pieces 50A, 50B, respectively. In this embodiment, the extension pieces 50A, 50B protrudes downward such that the opening 51A, 51B are in close proximity to the hole bottom while drilling. In other embodiments, a nozzle may be attached to the openings 51A, 51B.

Returning to FIG. 11B, cone cleaning nozzles 26A, 26B are directed towards the leading sides of the roller cones 15A, 15B, respectively. The leading side is defined by the direction of rotation of the drill bit while drilling, which is typically right-hand (clockwise). Because FIG. 11B is a bottom view, the direction of rotation is counter-clockwise. The leading sides of the roller cones 15A, 15B are defined as the sides of the roller cones 15A, 15B that are about to cut the earth formation. Trailing sides of the roller cones 15A, 15B are defined as the sides of the roller cones 15A, 15B that have just cut the earth formation. In some situations, it has been found that directed cone cleaning nozzles 26A, 26B towards the leading sides of the roller cones 15A, 15B is more effective in preventing bit balling. In other embodiments, it may be desired that the cone cleaning nozzles 26A, 26B be directed towards the trailing sides of the roller cones 15A, 15B. This may be accomplished, for example, by reversing the orientations of the nozzle receptacle in spacing member 29.

Figure 13A:
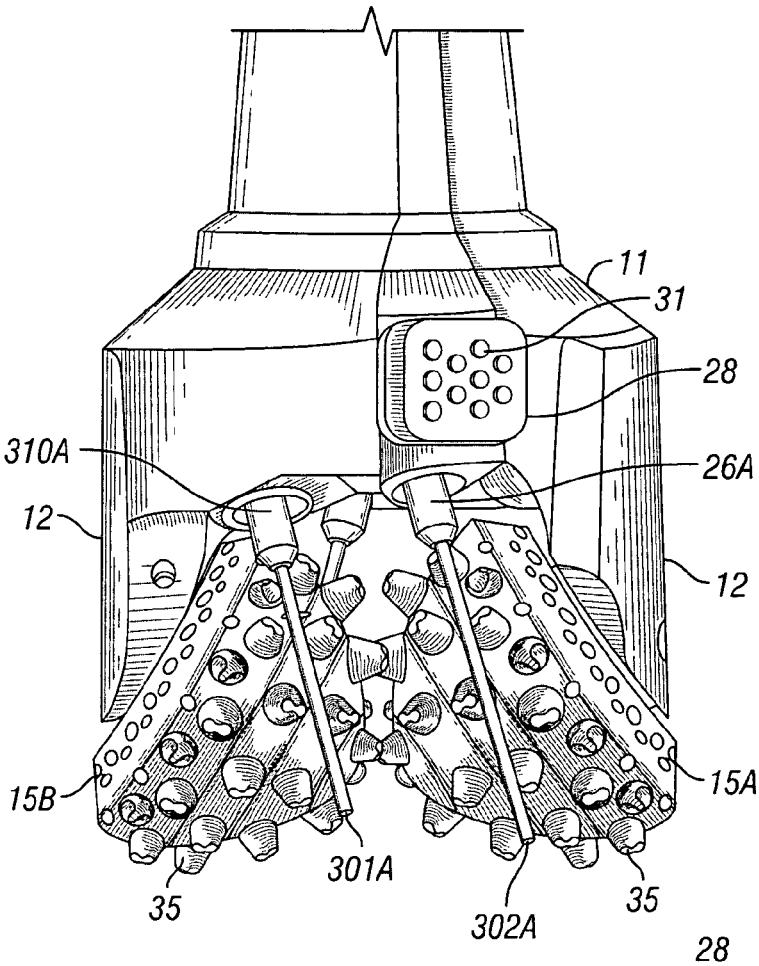
FIG. 13A shows a side view of a two-cone drill bit in accordance with an embodiment of the present invention.
Figure 13B:
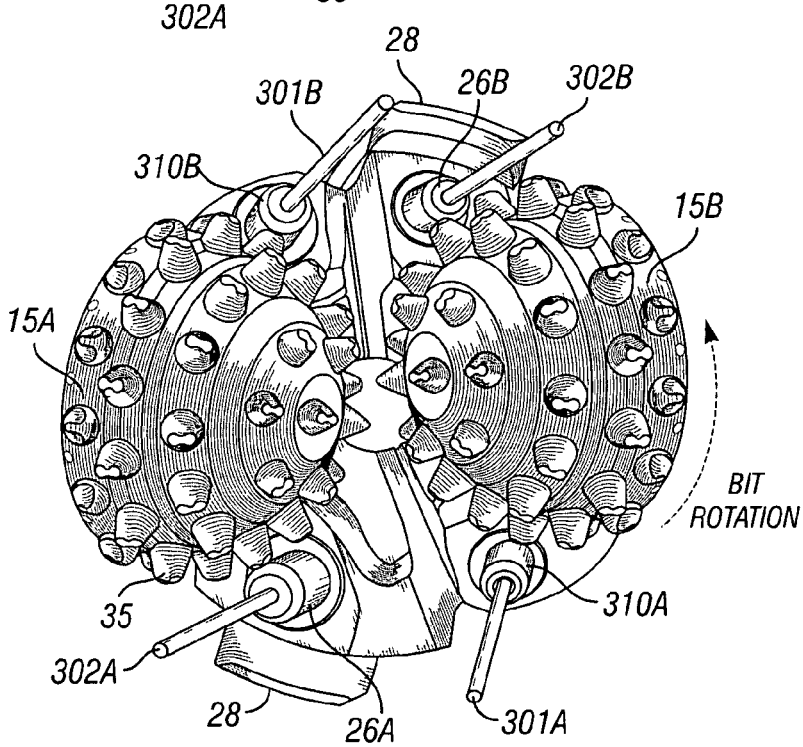
FIG. 13B shows a bottom view of the two-cone drill bit shown in FIG. 13A.

Turning to FIGS. 13A and 13B, a two-cone drill bit in accordance with an embodiment of the present invention is shown. In FIGS. 13A and 13B, the drill bit has four nozzles 26A, 26B, 310A, 310B. The four nozzles 26A, 26B, 310A, 310B are in two pairs (26A with 301A, and 26B with 301B) on opposing sides of the drill bit and are positioned between the two legs 12. In each pair, a cone cleaning nozzle 26A,26B is oriented with a lateral angle and a radial angle such that a fluid stream 302A, 302B passes near the cutting elements 35 on one of the roller cones 15A, 15B for the purpose of cleaning one of the roller cones 15A, 15B. Also in each pair, a helical flow nozzle 310A, 310B generally in the same direction as the cone cleaning nozzles 26A, 26B such that a fluid stream 301A, 301B is directed in a similar direction to the fluid streams 302A, 302B. In this embodiment, the fluid streams 301A, 301B do not contact any portion of the drill bit before impinging on the hole bottom (not shown). Because the fluid streams 301A, 301B do not contact the hole bottom at nearly 90 degrees, the impingement pressure on the hole bottom is not maximized. Instead of maximally impinging on the hole bottom, a significant portion of the hydraulic energy from the fluid streams 301A, 301B is used to move fluid around the drill bit in a helical direction. This helps to provide a continuous fluid stream around the drill bit with a minimal amount of recirculation zones. The helical flow helps to lift cuttings away from the hole bottom so that the cuttings can be brought to the surface.

Cone cleaning nozzles generally have lateral angles greater than 0 degrees so that fluid is directed towards the roller cone to be cleaned. In the particular embodiment shown in FIGS.

13A and 13B, the cone cleaning nozzles 26A, 26B have lateral angles greater than a magnitude of about 10 degrees. In other embodiments, particularly those with nozzles located in closer proximity to the roller cone to be cleaned, the lateral angle may be reduced to about a magnitude of 6 degrees.

Figure 17:
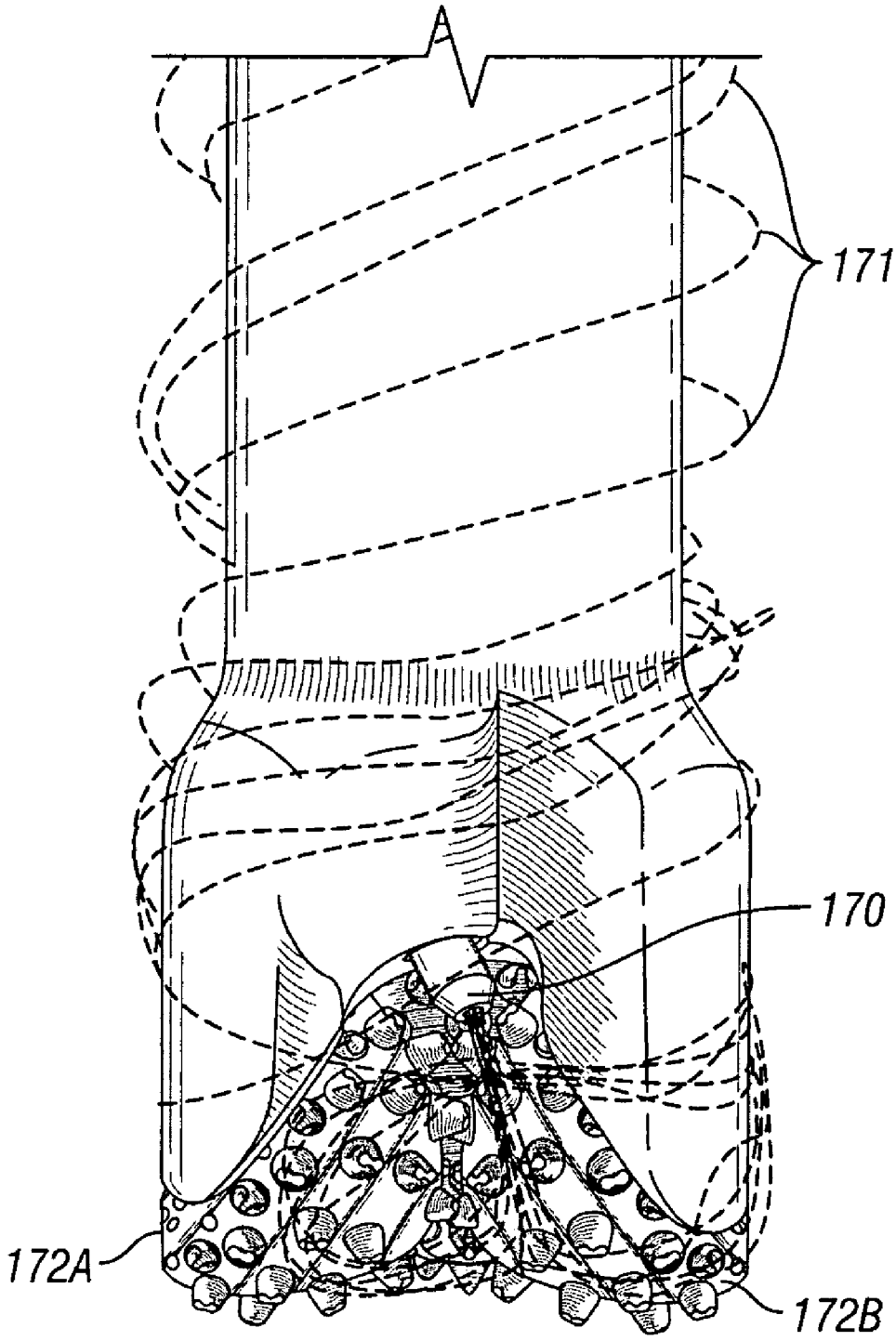
FIG. 17 shows a fluid flow analysis of a three-cone drill bit with a cone cleaning nozzle.

As used herein, the term "helical flow nozzle" is used for nozzles that have high lateral angles, but that do not pass within close proximity to a cone shell or other bit body part. Both cone cleaning nozzles and helical flow nozzles induce a helical flow field around the bore hole. Because the jets add fluid to the hole, the fluid is constantly moving upward toward the exit at the surface of the hole. FIG. 17 shows a cone cleaning nozzle 170 with a high lateral angle. Pathlines 171 show the path that a particle ejected from the nozzle would likely follow as it moves up the bore hole. The helical nature of the flow field is clearly visible. The minimization of recirculation zones that move cuttings back under cones 172A and 172B is thought to improve cuttings removal, which helps to increase the penetration rate of the drill bit. Helical flow nozzles induce a similar type of flow field, but do not impart significant energy on any of the drill bit surfaces for the purpose of cleaning the surface.

Returning to the chart in FIG. 2, the impingement pressure on the hole bottom is significantly smaller for nozzles that have high lateral angles as shown by the lines comparing the cutting structure (i.e. roller cone) cleaning to the standard nozzle hole bottom cleaning. Helical flow nozzles, which have similar lateral angles as cutting structure cleaning nozzles, expend significantly less energy on creating high impingement pressures on the hole bottom than does a hole bottom cleaning nozzle. The present inventors have found that prior art two-cone drill bits typically have large areas of fluid separation between the two-cones, which weakens the helical flow around the bore hole. Helical flow nozzles re-energize the helical flow field moving around the bit, which improves cuttings removal. Because nozzles with high lateral angles impinge the hole bottom surface with relatively large angles, the impingement pressure is low when compared to hole bottom cleaning nozzles that impinge hole bottom close to perpendicular.

The present inventors have discovered that a helical flow can be achieved by orienting one or more helical flow nozzles at a lateral angle of about a magnitude of 6 degrees or greater. Lateral angles less than a magnitude of 6 degrees provide increased impingement pressure, and tend to impede a helical flow profile around the bit. In some embodiments, it may be preferable to have a lateral angle greater than a magnitude of about 10 degrees to induce a helical flow. In another embodiment, the helical flow nozzle may have a lateral angle of a magnitude of 15 degrees to a magnitude of 40 degrees to induce a helical flow. One of ordinary skill in the art will appreciate that the lateral angle may vary to induce a helical flow field without departing from the scope of the invention.

In another embodiment, the helical flow nozzle is oriented to create helical flow by orienting the helical flow nozzle to direct fluid towards the hole wall. As used herein, the "hole wall" refers to the portion of the well bore that has a diameter greater than or equal to the gage diameter of the drill bit. The present inventors have found that orienting a helical flow nozzle to direct fluid towards the hole wall can improve helical flow around the hole wall. In one or more embodiments, the helical flow nozzle may be directed towards a gage area or the wall of the well bore. As used herein, the "gage area" of the well bore is the portion of the well bore near the bottom of the hole that is substantially equal to the full gage diameter of the well bore. The present inventors believe that orienting a helical flow nozzle to direct fluid towards the gage area creates a sweeping effect near the gage area, which further assists in cuttings removal. The helical flow nozzle could also be directed inboard of gage on the hole bottom as long as it provides the energy to induce a helical flow field around the bit body.

Figure 14A:
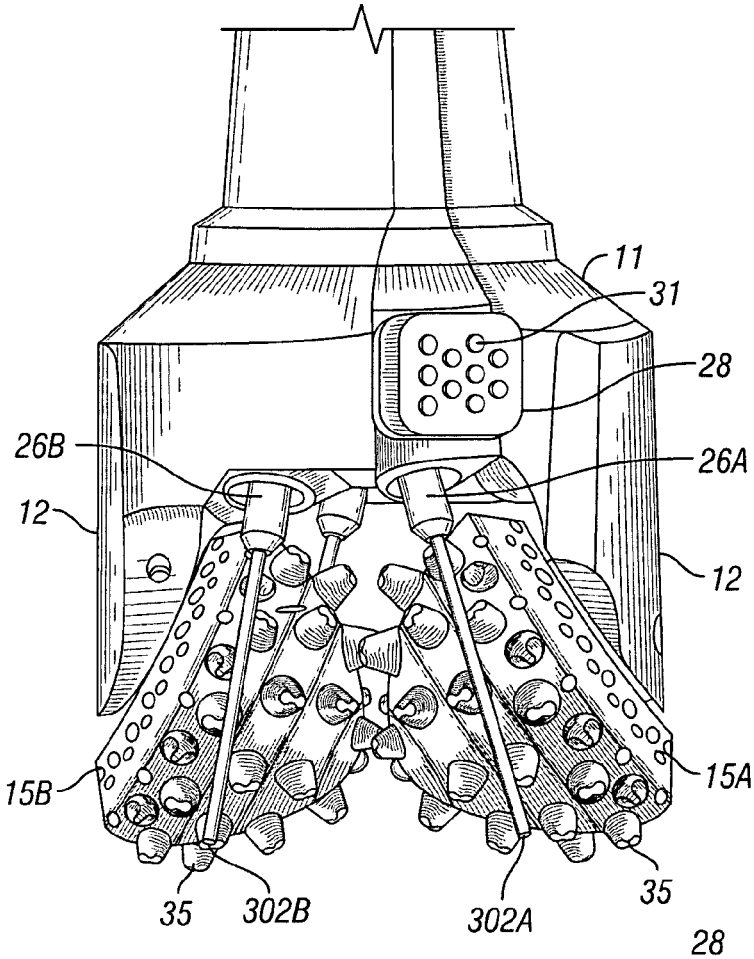
FIG. 14A shows a side view of a two-cone drill bit in accordance with an embodiment of the present invention.
Figure 14B:
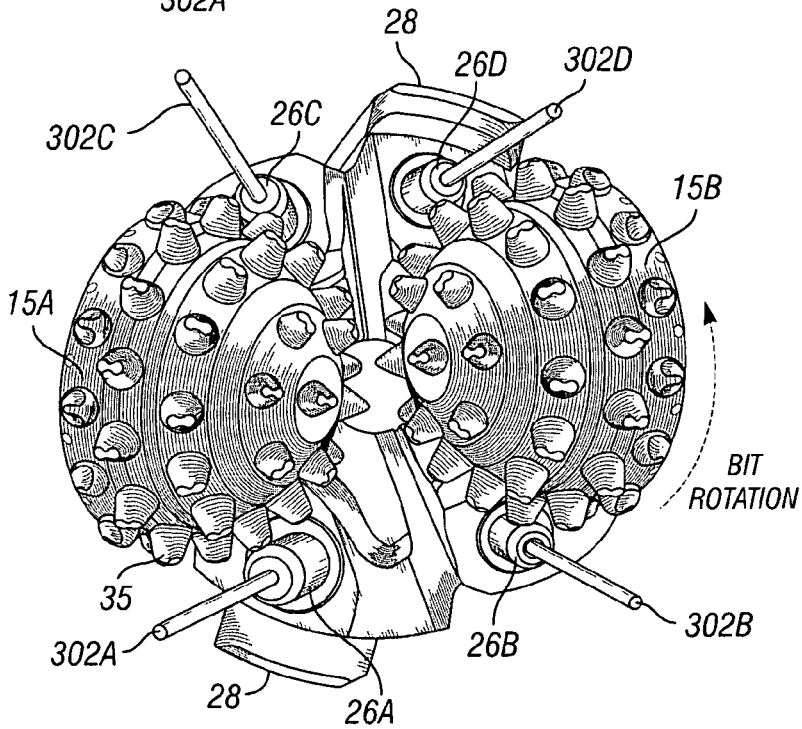
FIG. 14B shows a bottom view of the two-cone drill bit shown in FIG. 14A.

In FIGS. 14A and 14B, a two-cone drill bit in accordance with an embodiment of the present invention is shown. The drill bit in FIGS. 14A and 14B has four cone cleaning nozzles 26A-D. The four cone cleaning nozzles 26A-D are in two pairs (26A with 26B, 26C with 26D) on opposing sides of the drill bit and are positioned between the two legs 12. In one pair, a cone cleaning nozzle 26A is oriented at a lateral angle such that a fluid stream 302A passes near the cutting elements 35 on the leading side of the roller cone ISA for the purpose of cleaning the roller cone ISA. The other cone cleaning nozzle 26B in the pair is oriented such that a fluid stream 302B is directed towards the trailing side of the other roller cone 15B. A similar orientation may be used for the other pair of cone cleaning nozzles 26C, 26D on the opposing side of the drill bit with fluid stream 302C, 302D. This design may be desirable in drilling situations in which the primary concern is bit balling. In this particular embodiment, each cone cleaning nozzle 26A-D within each pair is directed towards a different roller cone 15A, 15B. In other embodiments, both cone cleaning nozzles 26A, 26B, or 26C, 26D) in each pair may be directed towards the same side (trailing side or leading side) of the same roller cone 15A, 15B. Further, each cone cleaning nozzle 26A-D may be directed towards cleaning a different portion of each roller cone 15A, 15B.

Figure 15A:
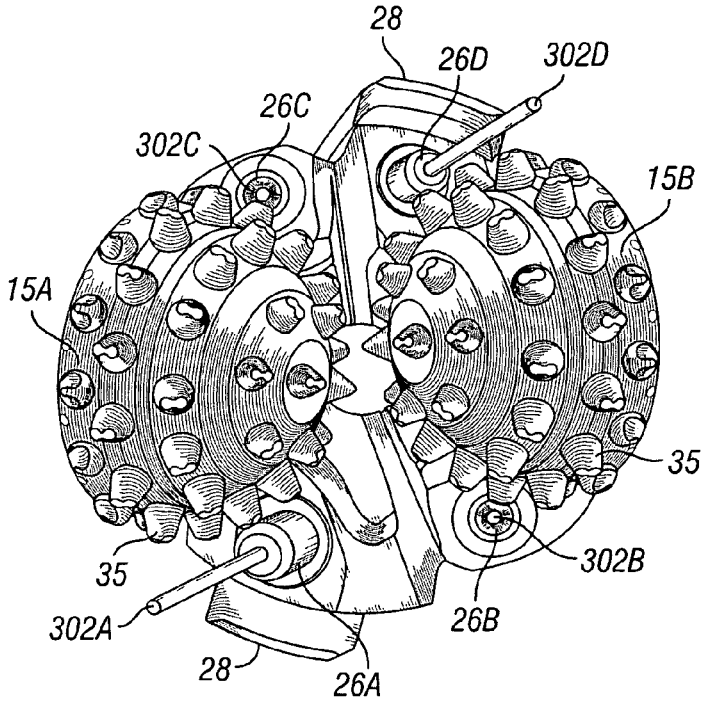
FIG. 15A shows a side view of a two-cone drill bit in accordance with an embodiment of the present invention.
Figure 15B:
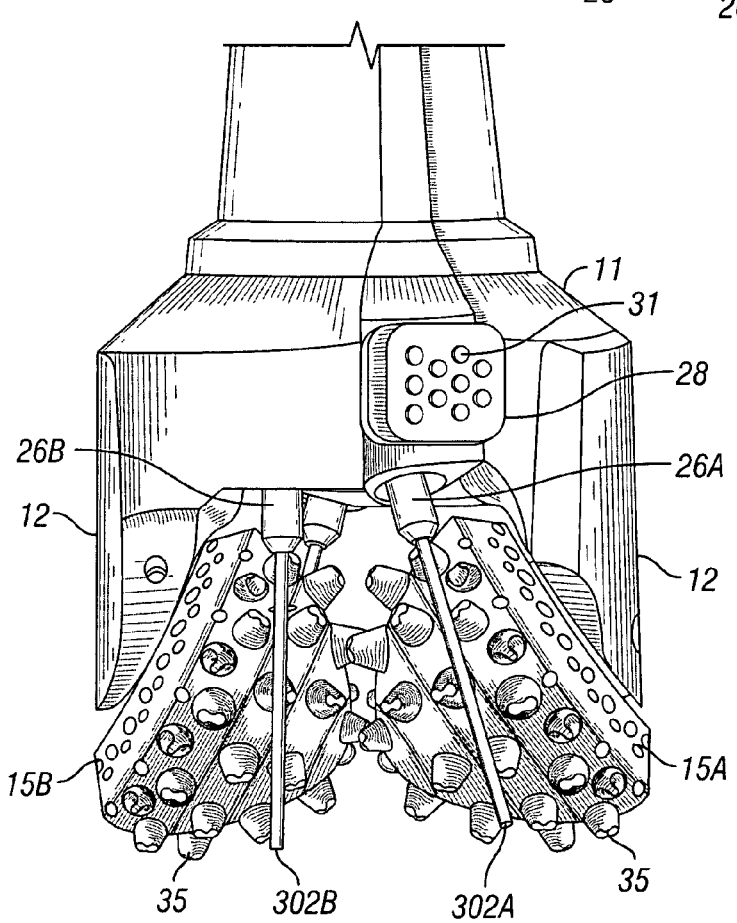
FIG. 15B shows a bottom view of the two-cone drill bit shown in FIG. 15A.

Turning to FIGS. 15A and 15B, a two-cone drill bit in accordance with an embodiment of the invention is shown. The drill bit in FIGS. 15A and 15B has four cone cleaning nozzles 26A-D. The four cone cleaning nozzles 26A-D are in two pairs (26A with 26B, 26C with 26D) on opposing sides of the drill bit and are positioned between the two legs 12. In each pair, one cone cleaning nozzle 26A is oriented at a lateral angle such that a fluid stream 302A passes near the cutting elements 35 on the leading side of the roller cone 15A for the purpose of cleaning the roller cone 15A. The other cone cleaning nozzle 26B in the pair is oriented with substantially zero lateral angle, and located such that a fluid stream 302B passes near the trailing side of roller cone 15B. As the cutting elements 35 on roller cone 15B move in and out of fluid stream 302B, a significant amount of hydraulic energy is dissipated on the cutting structure to clean roller cone 15B. A similar orientation may be used for the other pair of nozzles on the opposing side of the drill bit. This design may be desirable in drilling situations in which the primary concern is bit balling.

The sizes (i.e. the inner diameter) of nozzles for drill bits in accordance with embodiments of the present invention may vary based on design and use considerations. For example, relatively large nozzles may be used when the drill bit will be used in applications with high flow rates. Further, the nozzles used in some embodiments of the present invention may have different sizes relative to each other. For example, in one embodiment, a smaller nozzle may be used for cleaning the roller cones, and a larger nozzle may be used for impinging on the hole bottom. One of ordinary skill in the art will appreciate that many sizes and combinations of sizes may be used for each of the hydraulic functions disclosed herein without departing from the scope of the invention.

While the above embodiments have illustrated two-cone drill bits with symmetric hydraulic arrangements (i.e. one pair of openings or nozzles performing the same function as an opposing pair), in other embodiments opposing pairs of nozzles may have separate functions. For example, of the four nozzles, one nozzle may be directed to induce a helical flow, a nozzle for cleaning each roller cone, and a nozzle for impinging on the hole bottom. Alternatively, all nozzles may be directed towards the same function. One of ordinary skill in the art will appreciate that other combinations of functions may be achieved without departing from the scope of the present invention.

While the above embodiments illustrate two-cone drill bits having hydraulic arrangements that help in preventing bit balling and bottom balling, as well as induce helical flow, one of ordinary skill will appreciate that only one or two of those functions may be desired in some situations. To accomplish this, any of the openings may be plugged during operation according to the particular circumstances of a drilling operation. For example, if the formation to be drilled is primarily a hard sandstone formation, bit balling may not be an issue. In that situation, some or all of the openings directed towards cleaning the roller cones may be plugged to direct more hydraulic energy towards the hole bottom to aid in breaking away chips of rock from the hole bottom and avoiding bottom balling. In other situations, the center opening may be plugged to increase the hydraulic energy directed to the other openings. One of ordinary skill in the art will appreciate that any of the openings may be plugged without departing from the scope of the present invention.

While the above discussion has focused on two types of nozzles, a standard embedded nozzle and an extended nozzle, other nozzles, such as diffuser nozzles, may also be used. Other nozzles known in the art may be appropriate for performing functions as described above. One of ordinary skill in the art will appreciate that any particular nozzle may be selected without departing from the scope of the present invention. Further, nozzles in the above embodiments have been named by function for clarity. The same type of nozzle (e.g. extended nozzle) may be used for any of the described functions by varying the orientation and location of the nozzle in accordance with embodiment of the present invention.

Openings in the bit bodies in the above embodiments have been distinguished by the intended purpose, those for cleaning the roller cones, those for impinging on the hole bottom, and those for inducing a helical flow field. The openings for impinging on the hole bottom may vary in direction and orientation as required by the formation to be drilled. For example, the openings for impinging on the hole bottom may be directed such that fluid discharging from the openings impinges at an angle relative to the hole bottom. For the purposes of illustration, fluid directed perpendicular to the hole bottom would have 0 degree lateral and radial angles. Being directed with the direction of rotation would be considered a positive angle, while against the direction of rotation would be negative. Impinging on the hole bottom at a positive angle aids in breaking lose cuttings. In some embodiments, it may be desired to have an angle of 0 to 60 degrees. In other embodiments, an angle between 30 and 50 degrees may be selected. This causes the fluid to both penetrate the formation and to provide a shear force for breaking cuttings loose. Additionally, the openings for impinging on the hole bottom may be directed such that fluid is directed across the hole bottom. One of ordinary skill in the art will appreciate that the openings for impinging on the hole bottom may vary in direction and orientation without departing from the scope of the present invention.

As previously discussed, a two-cone drill bit in accordance with an embodiment of the invention may be formed by combining multiple sections, namely the leg sections and spacing members. For increased strength, the leg sections may be formed using a forging process. The forging process is limited in possible geometry that can be formed. Forgings require that there are not any overhanging surfaces and that all surfaces have draft so that the part doesn't stick in the tool during manufacturing. This prevents forged leg sections from having additional internal geometry. It also prevents a bit body from being formed from only two pieces. Typically, leg sections are formed using the forging process because of the material strength required by drilling forces. Forging also provides a more economical manufacturing method than most machining processes. Advancements in casting technology may allow for leg sections of sufficient strength to be made in the future. One of ordinary skill in the art will appreciate that the manufacturing process in making leg sections may vary without departing from the scope of the present invention.

The spacing members, hydraulic attachment pieces, and extension pieces may be formed using a casting process because of the lower mechanical loads experienced by those pieces. Casting allows for smooth internal shapes to improve fluid flow through each of the pieces. Each of the pieces may be formed such that an uninterrupted fluid plenum is created when the pieces are combined. The spacing members, hydraulic attachment pieces, and extension pieces may each include smooth transitions to their respective openings. This provides a smooth flow path for fluid to reduce fluid separation, and the loss of energy and erosion that results from it. However, one of ordinary skill in the art will appreciate that the pieces could also be machined from a solid piece of material, or could be made using other manufacturing methods to create the desired pieces without departing from the scope of the invention.

While the embodiments shown herein utilize spacing members and leg sections that are formed separately, many of the hydraulic configurations disclosed herein could be accomplished using other methods of assembly. For example, the body of the drill bit could be cast, and forged legs welded to the body for attaching the roller cones. Hydraulic conduits could then be machined into the cast body to provide the nozzle orientations necessary to accomplish the bottom hole cleaning, cone cleaning, or helical flow field generation.

Figure 18:
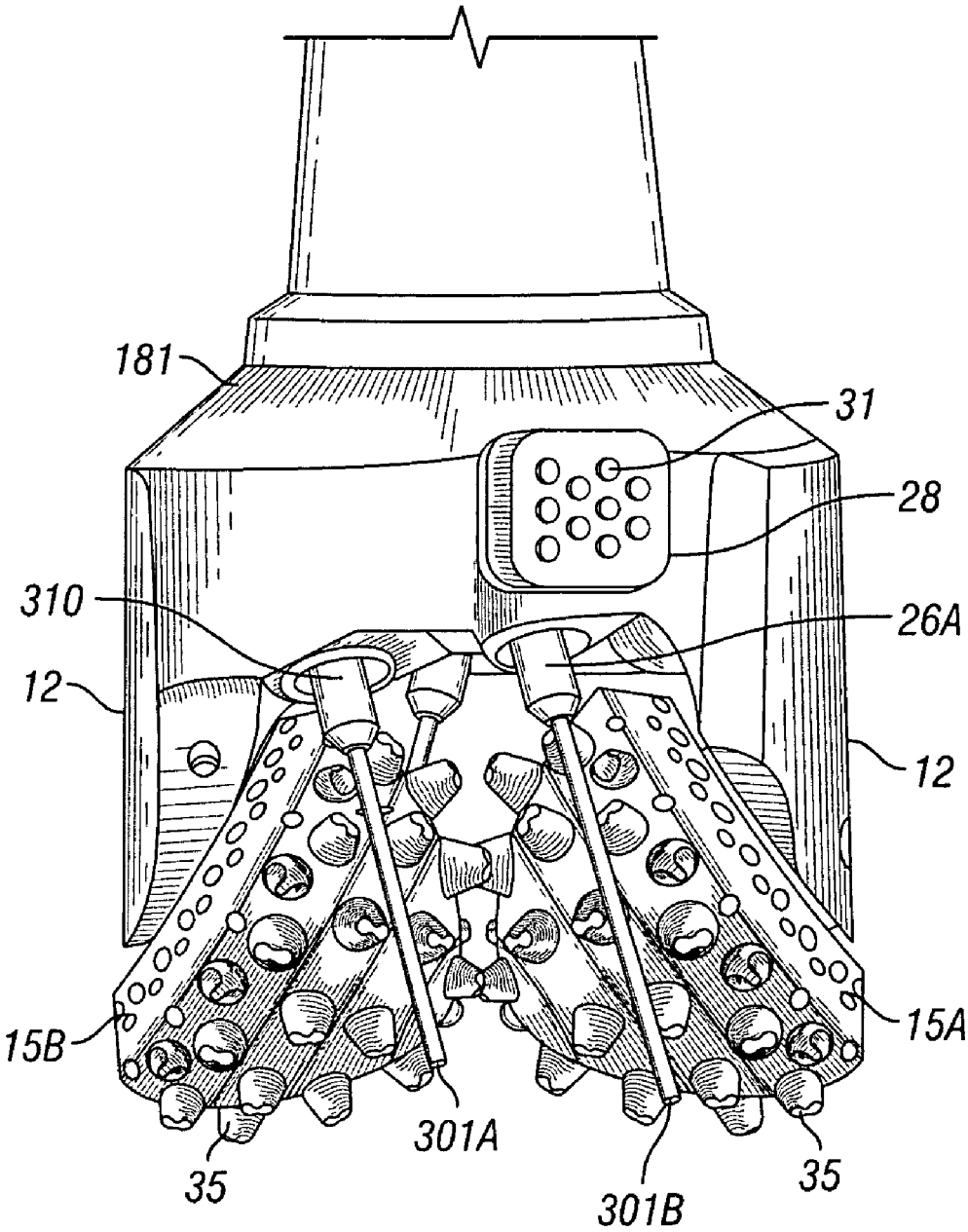
FIG. 18 shows a side view of a two-cone drill bit in accordance with an embodiment of the present invention.

In FIG. 18, a two-cone drill bit in accordance with an embodiment of the present invention is shown. The two-cone drill bit shown in FIG. 18 has a similar hydraulic configuration as the embodiment shown in FIG. 13A. In the particular embodiment shown in FIG. 18, a bit body 181 has been formed as a single piece. The bit body 181 has legs 12 formed thereon. In one embodiment, the legs 12 may be formed separately (e.g. by machining, forging, or casting), and then welded onto the bit body 181. In this particular embodiment, the legs 12 have been integrally formed with the bit body 181.

Embodiments of the invention may provide one or more of the following advantages. Embodiments of the invention provide a flexible hydraulic arrangement for two-cone drill bits. For drill bits, the tooling required to make a specific forging is a significant cost of manufacturing. Larger quantities of individual pieces help to reduce the cost per piece through efficiency, while also amortizing the tooling costs. A flexible design of a drill bit allows for the use of the same major pieces (i.e. leg sections) for different applications, thus increasing the manufacturing quantity and reducing the overall cost per piece. The flexible hydraulic arrangement disclosed herein may be adapted to many drilling situations while only changing minor pieces. For example, a variety of hydraulic attachment pieces may be designed to attach to a pocket formed in the leg section. Most of the drill bit may be manufactured prior to selecting the particular hydraulic attachment piece. The hydraulic attachment piece, which is relatively low in cost, may be attached when the particular use of the drill bit is known. Similarly, nozzles may be selected to alter the directions of flow for both bottom hole and cone cleaning applications. Additionally, openings may be plugged in some situations. Such flexibility in the hydraulic arrangement allows for a drill bit that is adaptable to a variety of earth formations.

Embodiments of the invention may reduce bottom balling and bit balling, while improving cuttings removal by inducing a helical flow simultaneously. Alternatively, embodiments of the inventions may be focused on one or two of the hydraulic functions. The hole bottom cleaning nozzles may be used to expose fresh formation prior to contacting the roller cones. The cone cleaning nozzles may remove cuttings that have collected on the outer portions of the roller cones. Additionally, a center nozzle may remove cuttings that collect on the inner portions of the roller cones. All or some of these nozzles may be selected for a particular drilling situation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A two-cone drill bit for drilling a well bore, the two-cone drill bit comprising:

a bit body comprising, a connection adapted to connect to a drill string, two leg sections each having a leg formed thereon and disposed between about 145 degrees and about 166 degrees from each other, a fluid plenum, and two spacing members disposed on opposite sides from each other between each of the two leg sections, wherein each of the two spacing members comprise two openings therein, each forming a conduit for channeling a fluid from the fluid plenum to outside the bit body; and a roller cone rotatably mounted to each leg;

wherein the bit body comprises at least two components other than the two legs extending to bit gage.

2. The two-cone drill bit of claim 1, further comprising:

a nozzle attached to at least one of the openings.

3. The two-cone drill bit of claim 2, wherein the nozzle is oriented to direct a fluid stream to perform at least one function selected from the group consisting of cleaning the roller cone, impinging on a hole bottom, and inducing a helical flow field.

4. The two-cone drill bit of claim 2, wherein the nozzle comprises an extension piece.

5. The two-cone drill bit of claim 4, wherein the extension piece extends proximate to a hole bottom.

6. The two-cone drill bit of claim 1, wherein one of the conduits is oriented to direct the fluid to impinge on the hole bottom and another of the conduits is oriented to direct the fluid to clean one of the roller cones.

7. The two-cone drill bit of claim 1, wherein one of the conduits is oriented to direct the fluid to create a helical flow field and another of the conduits is oriented to direct the fluid to clean one of the roller cones.

8. The two-cone drill bit of claim 1, further comprising:

four nozzles each attached to one of the four openings, wherein each of the four nozzles is selected from the group consisting of a cone cleaning nozzle, a hole bottom cleaning nozzle, and a helical flow nozzle.

9. The two-cone drill bit of claim 8, wherein at least one of the nozzles is a cone cleaning nozzle oriented at a lateral angle greater than a magnitude of about 6 degrees.

10. The two-cone drill bit of claim 8, wherein at least one of the nozzles is a cone cleaning nozzle oriented at a lateral angle greater than a magnitude of about 10 degrees.

11. The two-cone drill bit of claim 8, wherein at least one of the nozzles is a hole bottom cleaning nozzle oriented at a lateral angle less than a magnitude of about 5 degrees.

12. The two-cone drill bit of claim 8, wherein at least one of the nozzles is a hole bottom cleaning nozzle oriented at a lateral angle of about 0 degrees.

13. The two-cone drill bit of claim 8, wherein at least one of the nozzles is a hole bottom cleaning nozzle oriented at a radial angle of about 0 degrees.

14. The two-cone drill bit of claim 8, wherein at least one of the nozzles is a helical flow nozzle oriented at a lateral angle greater than a magnitude of about 6 degrees.

15. The two-cone drill bit of claim 8, wherein at least one of the nozzles is a helical flow nozzle oriented at a lateral angle greater than a magnitude of about 10 degrees.

16. The two-cone drill bit of claim 8, wherein at least one of the nozzles is a helical flow nozzle oriented at a lateral angle greater than a magnitude of about 15 degrees.

17. The two-cone drill bit of claim 8, wherein at least one of the nozzles is a helical flow nozzle directed towards one selected from the group consisting of a hole bottom, a gage area of a well bore and a hole wall.

18. The two-cone drill bit of claim 8, wherein the four nozzles are cone cleaning nozzles.

19. The two-cone drill bit of claim 8, wherein the four nozzles are bottom hole cleaning nozzles.

20. The two-cone drill bit of claim 8, wherein two of the four nozzles are cone cleaning nozzles and two of the four nozzles are helical flow nozzles.

21. The two-cone drill bit of claim 8, wherein at least one of the nozzles is a helical flow nozzle directed towards the hole wall.

22. The two-cone drill bit of claim 1, wherein the bit body comprises:

a center opening in a bottom of the bit body.

23. The two-cone drill bit of claim 1, further comprising:

a gauge pad.

24. The two-cone drill bit of claim 1, wherein the two legs are disposed between about 163 degrees and about 165 degrees from each other.

25. The two-cone drill bit of claim 1, wherein at least one of the two openings on one of the two spacing members is at a location near the bottom of the drill bit.

26. The two-cone drill bit of claim 1, wherein both of the two openings on one of the two spacing members are directed towards different portions on one of the roller cones.

27. The two-cone drill bit of claim 1, wherein at least one of the two spacing members has one opening that is at a location near the hole bottom and wherein the other opening is directed towards a portion of a cone.

28. The two-cone drill bit of claim 1, wherein at least one of the two space members has an opening that is at a location near the hole bottom and wherein the other opening is directed to create helical flow.

29. The two-cone drill bit of claim 1, wherein the offset from the hole bottom of at least one opening on the first side of the bit is determined by the desired bottom hole energy and wherein the other opening is directed toward a portion of a cone.

30. The two-cone drill bit of claim 1, wherein the two-cone drill bit comprises at least one other opening.

31. The two-cone drill bit of claim 1, wherein each spacing member has at least two points of contact with the borehole.

* * * * *